US005405726A

United States Patent [19]

Abe et al.

[11] Patent Number: 5,405,726

[45] Date of Patent: Apr. 11, 1995

[54] METHOD AND APPARATUS FOR DECOLORIZATION, AND IMAGE FORMING APPARATUS

[75] Inventors: Yuki Abe; Rikuzou Kouzuki; Masakazu Okamoto; Yasunori Mikata; Masatsugu Tabata; Shigeki Inoue; Sadao Tanimoto, all of Kobe; Yoshihiro Uchimoto, Osaka; Katsumi Murofushi; Yoshikazu Hosoda, both of Kawasaki, all of Japan

[73] Assignees: Bando Chemical Industries. Ltd., Hyogo; Showa Denko Kabushiki Kaisha, Tokyo, both of Japan

[21] Appl. No.: 974,122

[22] Filed: Nov. 10, 1992

[30] Foreign Application Priority Data

Nov. 11, 1991 [JP] Japan ..... 3-294552
Nov. 15, 1991 [JP] Japan ..... 3-300048

[51] Int. Cl.[6] ..... G03G 21/00

[52] U.S. Cl. ..... 430/97; 430/10; 430/19; 283/85; 428/916; 8/103

[58] Field of Search ..... 430/10, 19, 97, 944; 283/85; 428/916; 8/103

[56] References Cited

U.S. PATENT DOCUMENTS

| | | | |
|---|---|---|---|
| 4,992,347 | 2/1991 | Hawkins et al. | 430/10 |
| 5,045,420 | 9/1991 | Hosono et al. | 430/45 |
| 5,166,041 | 11/1992 | Murofushi et al. | 430/339 |

FOREIGN PATENT DOCUMENTS

| | | | |
|---|---|---|---|
| 0468465A1 | 1/1992 | European Pat. Off. . | |
| 2202497 | 8/1972 | Germany | 430/97 |
| 3007296 | 9/1981 | Germany | 430/19 |
| 3919312A1 | 12/1989 | Germany . | |
| 127711 | 11/1978 | Japan | 430/19 |

OTHER PUBLICATIONS

Patent Abstracts of Japan, vol. 11, No. 261 (P-609)(2708) 25 Aug. 1987 & JP-A-62 067 560 (RICOH) 27 Mar. 1987 *abstract*.

*Primary Examiner*—Roland Martin
*Attorney, Agent, or Firm*—Wenderoth, Lind & Ponack

[57] ABSTRACT

A sheet of paper, plastic or the like on which an image has been formed using a toner that is photochemically decolorizable by absorption of near infrared rays is illuminated with near infrared rays under the state wherein the image is heated to a temperature equal to or higher than the glass-transition temperature of a binding resin of the toner. The color of the toner can thereby be easily and rapidly eliminated. This enables the reuse of the sheet to be realized easily and at a low cost.

27 Claims, 23 Drawing Sheets

METHOD AND APPARATUS FOR DECOLORIZATION, AND IMAGE FORMING APPARATUS

BACKGROUND OF THE INVENTION

1. Field of the Invention

This invention relates to a method and apparatus for decolorizing toner images formed on a sheet from toner which can be photochemically decolorized, and also to an image forming apparatus.

2. Description of the Related Art

Recently, in view of the conservation of nature, particularly the conservation of forests and the reduction of wastes in urban areas, the reuse and regeneration of used paper have again attracted public attention. As part of such a recycling, the reuse of waste copy sheets, printed matter, facsimile sheets and the like used in offices has been studied.

Since the majority of such waste paper consists of confidential documents which are generally company secrets, however, it is very difficult to collect such waste paper outside the company to regenerate the paper. Furthermore, it is very difficult to erase recorded or printed portions of printed matter and copy sheets, and therefore printed matter and copy sheets are forced to be burned or shredded. Consequently, the general recognition is that it is substantially impossible to reuse such paper.

In view of the above, the inventors have conducted studies to find a near infrared-decolorizing pigment which absorbs near infrared rays to be decolorized, and developed a toner using such a pigment. This toner was proposed in Japanese patent application No. HEI3-277725 (1991).

When an electrostatic copy operation is conducted using that toner, images or characters formed on a sheet such as a copy sheet can be erased only by illumination with near infrared rays, and after this erasure an electrostatic copy operation or printing can be further conducted on the sheet, thereby allowing the sheet to be reused. When such used sheets are to be disposed of, recorded images or characters can be erased only by the illumination by near infrared rays. Therefore, there are many advantages, such as the sheets being collected to be reused in a company without leaking secrets to the outside.

However, the rate of decolorization when performed only by illumination with near infrared rays is low. For example, the process of decolorizing a toner image formed on the entire surface of a recording sheet of A4 size of JIS (Japanese Industrial Standard) requires several tens of seconds. Namely, this decolorizing process has a problem in that it can process only a few sheets per minute.

When an electrostatic photography copier or printer which forms an image on a recording sheet using such a decolorizable toner, and a decolorizing means for decolorizing an image on a recording sheet to make the sheet colorless so it can be reused, are independently installed, there arises another problem in that they require a large installation space. Even if the recording has been done using a decolorizable toner, the recording sheets cannot be reused unless the decolorizing means is available. Therefore, it is cumbersome to separately install the electrostatic photography image forming apparatus and the decolorizing means so as to be paired with each other.

A currently used electrostatic photography copier or printer and the toner therefore are constructed to function in pairs. Namely, the most suitable toner is selected for each kind of copier and printer. Therefore, there is no toner that can be suitably and commonly used for all kinds of copiers and printers. Copiers and printers are designed and adjusted so that various toners of different characteristics achieve optimum image qualities. Even if many kinds of decolorizable toners with different characteristics become available, therefore, a decolorizable toner and an electrostatic photography image forming apparatus which is designed and adjusted to be optimum for the use of that decolorizable toner must be used in pairs. Consequently, the decolorizable toner, electrostatic photography image forming apparatus means and decolorizing means are realized so that their characteristics relate to each other. When electrostatic photography image forming means and decolorizing means are constructed independently of each other, it is required to separately prepare individual image forming means and decolorizing means in accordance with a decolorizable toner to be used. This involves cumbersome work when decolorizable toner, an electrostatic photography image forming apparatus and decolorizing means are combined in an unsuitable manner, it may be impossible to form optimum images on recording sheets or to sufficiently achieve the decolorization.

SUMMARY OF THE INVENTION

It is an object of the invention to provide a decolorizing method which can solve the above-mentioned problems and greatly improve the rate of decolorizing a toner image formed on a sheet.

In order to accomplish the object, the decolorizing method of the invention comprises the steps of heating a toner image formed on a sheet from a photochemically decolorizable toner, at least to a temperature equal to or higher than the glass-transition temperature of a binding resin of the toner and illuminating the toner image with near infrared rays concurrently with or soon after the heating of the toner image.

According to the invention, when a toner image formed on a sheet from a photochemically decolorizable toner is to be decolorized, the toner is heated by a heating means at least to a temperature equal to or higher than the glass-transition temperature of a binding resin of the toner, thereby increasing the heat momentum of the molecules constituting the toner on the sheet. Since the toner has a structure that exhibits a decolorizing effect upon absorption of near infrared rays, this heating causes the toner on the sheet to be transferred from a solid state to a rubber-like elastic state or a melting state. When the toner in this state is illuminated with the near infrared rays, this illumination by the near infrared rays allows the decolorization to easily occur.

In this way, the sheet can be reused. The decolorization is a chemical reaction, and the decolorizing reaction in the invention is irreversible. Since the heated toner is in a state in which the molecules constituting the toner are excited and is at least in a state of rubber-like elasticity, the chemical reaction of decolorizing the toner by the illumination with near infrared rays proceeds very rapidly as compared with the toner in a solid state, thereby improving the rate of decolorization. Furthermore, the decolorizing reaction is realized by an irreversible chemical reaction, so that decolorized toner images on the sheet are prevented from being changed back to a colored state or being discolored in dependance on the ambient temperature, the illumination or non-illumination by the usual white light or the chemical conditions.

Sheets which can be made reusable by the invention include all kinds of sheets of paper, plastic film or the like for an office or business use that can be subjected to the electrostatic copying operations, for example, recording sheets used in a conventional electrostatic photography copying apparatus, OHP (Over Head Projector) films, magnetic cards, plastic film sheets for display, etc. When characters formed on a plastic film sheet are to be decolorized, the thermal deforming temperature of the plastic film sheet must be equal to or higher than the glass-transition temperature of the toner to be used.

In a preferred embodiment of the invention, the decolorizing method further comprises applying a physical deformation, such as rubbing or pressing, to the toner layer of the toner image concurrently with or before illuminating the toner image with near infrared rays.

According to the invention, when a toner image formed on a sheet from a photochemically decolorizable toner is to be decolorized, the toner is heated by a heating means at least to a temperature equal to or higher than the glass-transition temperature of a binding resin of the toner. This heating causes the toner on the sheet to be transferred from a solid state to a rubber-like elastic state or a melting state. The toner in this state is physically deformed by a deforming means for performing an action such as rubbing or pressing. A means for illuminating with near infrared rays illuminates the toner which has been physically deformed or is being physically deformed, with near infrared rays. Since the toner has a structure that exhibits the decolorizing effect in the case of absorption of near infrared rays, this illumination by the near infrared rays allows the decolorization to easily occur.

Since the toner, in a solid state on the sheet is heated to be transferred into a state having at least a rubber-like elasticity so as to increase the heat momentum of the molecules constituting the toner, and is then physically deformed, the toner is transferred into a state in which a chemical reaction between the molecules constituting the toner easily occurs. Moreover, the deformation of toner in a rubber-like elastic or melting state greatly increases the chance of causing the chemical reaction between molecules constituting the toner.

In a further preferred embodiment of the invention, the decolorizing method further comprises partially removing the toner layer of the toner image by reducing the thickness thereof by performing a shaving, peeling or similar operation on the toner layer.

According to the invention, when a toner image formed on a sheet from a photochemically decolorizable toner is to be decolorized, the toner of the toner image is partially removed to reduce its thickness by performing a shaving, peeling or similar operation on the toner. Simultaneously or thereafter the remaining toner is illuminated with near infrared rays, whereby a decolorizing reaction in the deep portion of a toner layer is promoted. As a result, the rate of decolorizing the toner image formed on the sheet is greatly improved. Since the toner is partially removed in the direction of the thickness of the toner layer to reduce the toner layer thickness, traces of the decolorized toner image on the sheet become inconspicuous.

In a further preferred embodiment of the invention, in the step of illuminating the toner image with near infrared rays, light from a light source converges to illuminate the toner image; light, except for direct light, converges on an area illuminated with the direct light from the light source.

According to the invention, the light density in the area illuminated with near infrared rays increases, and thereby the period of time for decolorizing is reduced.

In a further preferred embodiment of the invention, in the step of illuminating the toner image with near infrared rays, both sides of the sheet are illuminated with near infrared rays.

According to the invention, the light density in the area illuminated with near infrared rays increases greatly, and a deep portion of the toner layer, close to the sheet, is efficiently illuminated because the light can travel through the thin sheet.

In a further preferred embodiment of the invention, the same light source concurrently performs heating of the toner image with radiation heat and illuminating the toner image with near infrared rays.

According to the invention, the process of illuminating with near infrared rays and that of heating can be simultaneously conducted on the toner, so that the overall period required for decolorizing the toner is greatly shortened. This prevents the temperature of the toner after heating from decreasing.

It is another object of the invention to provide a decolorizing apparatus which can efficiently decolorize a photochemically decolorizable toner, has a short decolorizing time per sheet, and can be manufactured in a light and compact structure.

In order to accomplish the object, a decolorizing apparatus of the invention comprises means for transporting a sheet on which a toner image has been formed from photochemically decolorizable toner along a transporting path means for heating the toner image at least to a temperature equal to or higher than the glass-transition temperature of a binding resin of the toner disposed along the transporting path, and means for illuminating the toner image with near infrared rays concurrently with or soon after heating the toner image disposed along the transporting path.

According to the invention, the near infrared ray illuminating means illuminates the toner in a rubber-like elastic state or a melting state with near infrared rays, whereby the toner is made colorless. In this way, a sheet can be made reusable. Moreover, the decolorization is caused by a chemical reaction, and the decolorizing reaction can be irreversible.

Since the heated toner is in a state in which the toner has at least rubber-like elasticity, the chemical reaction of decolorizing the toner by the illumination with near infrared rays proceeds very rapidly as compared with that conducted on a toner in a solid state, thereby improving the rate of decolorization.

In a further preferred embodiment of the invention, the decolorizing apparatus further comprises means for applying a physical deformation, by rubbing or pressing for example to the toner layer of the toner image at a predetermined position along the transporting path that is illuminated with near infrared rays or upstream therefrom with respect to the transporting direction of the sheet.

According to the invention, a toner image formed on a sheet by a photochemically decolorizable toner is heated to a temperature which is equal to or higher than the glass-transition temperature, and preferably to the softening point of a binding resin of the toner, so that the toner is transferred into at least a rubber-like elastic state or a melting state. During or after the physical deformation by rubbing or pressing, the toner is illuminated with near infrared rays. This greatly increases the chance of causing an irreversible chemical reaction among the molecules constituting the toner, by which the toner is decolorized, and the period required for completing the decolorization of the toner is remarkably shortened.

In a further preferred embodiment of the invention, the decolorizing apparatus further comprises means for partially removing the toner layer of the toner image in the thickness direction by performing shaving, peeling or similar operation on the toner layer at a predetermined position along the transporting path that is illuminated with near infrared rays or upstream therefrom with respect to the transporting direction of the sheet.

According to the invention, when a toner image formed on a sheet by a photochemically decolorizable toner is to be decolorized, the toner of the toner image is partially removed in the thickness direction of the layer by performing a shaving, peeling or similar operation on the toner, and thereat or thereafter the toner is illuminated with near infrared rays, whereby the decolorizing reaction in the deep portion of the toner layer is promoted. As a result, the rate of decolorizing of the toner image formed on the sheet is greatly improved. Since the toner is partially removed in the thickness direction to reduce the layer thickness, traces of the decolorized toner image become inconspicuous.

In a further preferred embodiment of the invention, the means for illuminating the toner image with near infrared rays comprises a light source, and a means for converging near infrared rays at a predetermined position on the transporting path, the means being disposed between the light source and the transporting path.

According to the invention, the light utilization efficiency of the light source is improved and the size of the light source can be reduced by converging the near infrared rays. Furthermore, this can prevent the temperature of a heated sheet that has been elevated to a predetermined temperature by the heating means from lowering while the sheet is moving to the light condensing portion.

In a further preferred embodiment of the invention, a heat resisting glass plate for blocking the air flowing from the means for illuminating with near infrared rays toward the predetermined position is disposed between the means for illuminating with near infrared rays and the predetermined position.

According to the invention, the plate of heat resisting glass prevents air, the temperature of which has been raised by the heat of the light source, from moving toward the transporting path and its periphery, and allows air flow in the vicinity of the light source to be smoothly conducted.

In a further preferred embodiment of the invention, the transporting means comprises a member having a reflective surface directed toward the transporting path disposed at a position which is more distant from the means for illuminating with near infrared rays than from the transporting path of the sheet and in the vicinity of the predetermined position of the transporting path illuminated with the near infrared rays.

According to the invention, the member having a reflective surface the light from the light source on the light condensing portion, whereby the light utilization efficiency of the light source can be further improved.

In a preferred embodiment of the invention, at least one of the heating means and the means for illuminating with near infrared rays can be displaced from the transporting path from a predetermined decolorizing position.

According to the invention, when a sheet is blocked in the transporting path, i.e. a jam happens, the displacement of the heating means and/or the means for illuminating with near infrared rays forms a large space in the transporting path so that the user can easily remove the jam and safely and easily check and clean these means.

In a further preferred embodiment of the invention both the heating means and the means for illuminating with near infrared rays are realized as a light source conducting simultaneously both the process of heating with radiation heat and the process of illuminating with near infrared rays.

According to the invention, the process of the illumination with near infrared rays and the process of heating can be simultaneously conducted on the toner, so that the overall period required for decolorizing the toner is remarkably shortened.

In a further preferred embodiment, the light source is a flashlamp.

In a further preferred embodiment of the invention, the transportation speed of the sheet transported by the transporting means is variable.

According to the invention, when sheets having various decolorizing characteristics that change depending on the amount or thickness of the fixed toner are to be decolorized, sheets which are easy to be decolorized may be transported at a high speed so that the period required for decolorization is shortened, and sheets which are difficult to be decolorized may be transported at a low speed, so that the heating amount and light illuminating amount per sheet are increased, thereby surely performing the decolorization operation. Accordingly, it is possible to arbitrarily decide in accordance with the user's preference, the degree of decolorization residue which remains to be decolorized, or the period required for decolorization.

It is a further object of the invention to provide an image forming apparatus with a function of decolorization which can be installed in a small space, form optimum images using a decolorizable toner and surely conduct the decolorization operation.

In order to accomplish the object, an image forming apparatus is provided with a function of decolorization. An electrostatic photography image forming means forming images on a sheet using a photochemically decolorizable toner, and means for decolorizing the toner on the sheet by illuminating the toner with light for decolorization, are disposed on a transport path of the sheet. The transport path is formed in a body of the apparatus, and the electrostatic photography image forming means and the decolorizing means are selectively operated.

According to the invention, in a single body of a copier or printer, the electrostatic photography image forming means and the decolorizing means are arranged in series or juxtaposed in parallel on the transport path of the sheets. The electrostatic photography image forming means forms images on a sheet using electrostatic photography techniques and a photochemically decolorizable toner to perform the recording operation, and the decolorizing means illuminates the toner on the sheet with light for decolorization, whereby the toner is made colorless. In this way, the sheet can be made reusable. In the image forming apparatus with such a function of decolorization, since the electrostatic photography image forming means and the decolorizing means are accommodated in one body of the apparatus, it is not necessary to separately provide an image forming means and a decolorizing means, with the result that the installation space required becomes small. Moreover, this allows the combination of a toner, image forming means and decolorizing means to be accomplished in an optimum manner so that images of high quality can be formed and the decolorization operation can be surely conducted, thereby preventing trouble such as deteriorated image quality and insufficient decolorization which may be caused by a wrong combination of toner, image forming means and decolorizing means.

BRIEF DESCRIPTION OF THE DRAWINGS

Other and further objects, features, and advantages of the invention will be more explicit from the following detailed description taken with reference to the drawings, wherein.

DESCRIPTION OF THE PREFERRED EMBODIMENTS

Figure 1:
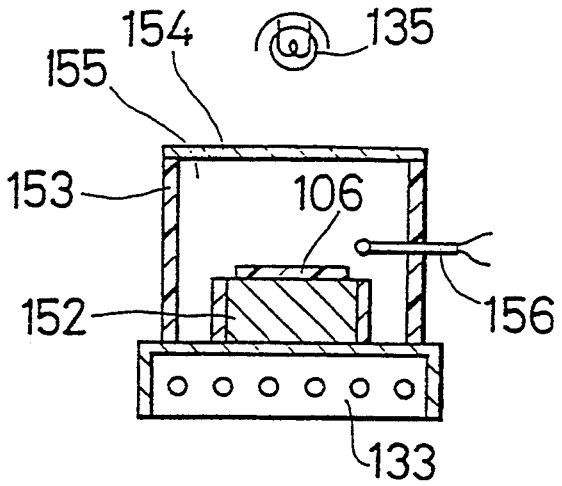
FIG. 1 is a sectional view showing the configuration of a decolorizing apparatus for a decolorizing method.

Referring now to the drawings, preferred embodiments of the invention are described below.

The process of forming images on sheets using a decolorizable toner which is useful in the invention is conducted In, for example, an electrostatic copier. The toner used in this electrostatic copier is a photochemically decolorizable toner which can be decolorized by the absorption of near infrared rays. Various examples of the composition of such a decolorizable toner and the detail of the manner of decolorizing toners of the various compositions are described in the aforesaid Japanese patent application No. HEI3-277725 (1991). Therefore, only several decolorizable toners are exemplified in the following description of embodiments. The invention is not restricted to the embodiments described below, and includes a wide variety of modifications according to the spirit of the invention.

An example of the decolorizable toner has a structure in which a pigment and organic boron ammonium salt are dispersed or dissolved in a styrene resin. The pigment is represented, for example, by Formula (1) or Formula (2) below:

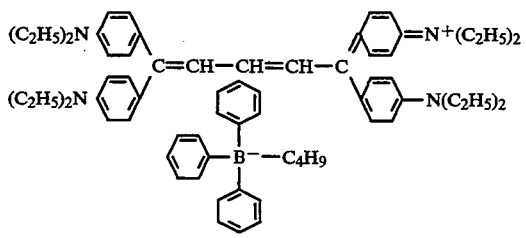

-continued (2)

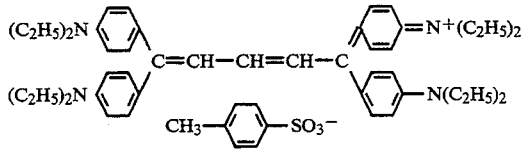

The styrene resin is widely used as a binding resin for a toner. The pigment represented by Formula (1) or (2) is a cyanine pigment which, when illuminated with near infrared rays having a wavelength of about 820 nm in the presence of organic boron ammonium salt, absorbs the near infrared rays to cause an irreversible reaction, resulting in that the pigment loses its blue color to become colorless. As the organic borate ammonium salt, tetrabutylammonium n-butyl triphenyl borate represented by following Formula (3) may be used:

(3)

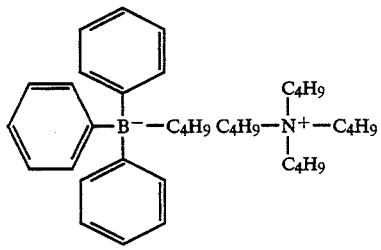

Ten decolorizable toners S1–S10 listed in Table 1 were prepared to be used in the embodiments described below.

Each of the mixtures S1–S10 listed in Table 1 was kneaded and mixed in a pressurized kneader at a temperature of 120° C. for 15 minutes. Then, it was solidified by cooling, and the solidified product was pulverized by a jet mill. The powder product was passed through a classifier to obtain a toner having a particle diameter of about 5 to 20 μm and the mean particle diameter of about 10 μm. To the toner, 0.5 parts by weight of silica fine powder was added as an additive per 100 parts by weight of the toner, and then the toner was mixed in a Henschel mixer. The silica fine powder adheres to the surface of the toner and functions to make the charged polarity of the toner uniform (e.g., a negative polarity), thereby improving the charge capacity of the toner and preventing the toner from aggregating so as to be solidified.

The carrier to be mixed with the toner of the embodiments was Cu-Zn ferrite, more specifically FB-810 (trade name) supplied by KANTO DENKA KOGYO CO., LTD. 95 parts by weight of the carrier and 5 parts by weight of the above-mentioned toner were placed in a propylene vessel and mixed at 50 rpm for 30 minutes to obtain a developer. Copy paper No. V602 supplied by FUJI XEROX CO., LTD. on which a toner image "TONER" consisting of characters of about 4 mm square was printed by a laser beam printer KX-P4420 supplied by KYUSYU MATSUSHITA ELECTRIC CO., LTD. was used as a sheet. The thickness of the toner image formed on the sheet was about 35 μm.

First Embodiment

When a toner image formed from the photochemically decolorizable toner having the structure described above is to be decolorized, the toner image is heated to a temperature equal to or higher than the glass-transition temperature TG of the binding resin, such as the styrene resin of the toner. More preferably, the toner image is heated to a temperature which is equal to or higher than the softening point MP of the binding resin and lower than the decomposition temperatures of the components constituting the toner such as the binding resin, the near infrared ray-absorbing pigment, and the sensitizer, such as the organic boron ammonium salt. When heated to a temperature equal to or higher than the glass-transition temperature TG, the binding resin transfers from a solid state to a rubber-like elastic state, and, when heated to a temperature equal to or higher than the softening point MP, it transfers to a melting state. In this embodiment, the toner in this state is illuminated with near infrared rays of the above-mentioned wavelength using a light source, thereby increasing the rate of decolorizing of the photochemically decolorizable toner.

Hereinafter, the principle of achieving the above-mentioned function and effects by heating the toner prior to the illumination with the near infrared rays will be described. The inventors performed the operation of heating the above-mentioned photochemically decolo-

TABLE 1

(Unit: Parts by weight)

| | S1 | S2 | S3 | S4 | S5 | S6 | S7 | S8 | S9 | S10 |
|---|---|---|---|---|---|---|---|---|---|---|
| RE1 | 100 | — | — | 100 | — | — | 100 | — | 100 | — |
| RE2 | — | 100 | — | — | 100 | — | — | 100 | — | 100 |
| RE3 | — | — | 100 | — | — | 100 | — | — | — | — |
| Wax | 5 | 5 | 5 | 5 | 5 | 5 | 5 | 5 | 5 | 5 |
| DY1 | 2 | 2 | 2 | — | — | — | 4 | 4 | — | — |
| DY2 | — | — | — | 2 | 2 | 2 | — | — | 4 | 4 |
| Sensitizer | 3.4 | 3.4 | 3.4 | 5.0 | 5.0 | 5.0 | 3.4 | 3.4 | 5.0 | 5.0 |

In Table 1 above, the symbols RE1–RE3 indicate binding resins such as a styrene acrylic resin. RE1 indicates HYMER SBM-100 supplied by SANYO CHEMICAL INDUSTRIES, LTD., which has a softening point MP of 104° C. and a glass-transition temperature TG of 60° C. RE2 indicates HYMER TB-1000 supplied by SANYO CHEMICAL INDUSTRIES, LTD., which has a softening point MP of 145° C. and a glass-transition temperature TG of 58° C., and RE3 indicates HYMER ST-125 supplied by SANYO CHEMICAL INDUSTRIES, LTD., which has a softening point MP of 125° C. and a glass-transition temperature TG of 50° C.

The symbols DY1 and DY2 indicate pigments, i.e., DY1 is the pigment represented by above Formula (1), and DY2 is the pigment represented by above Formula (2). The sensitizer in Table 1 is an organic boron ammonium salt which is tetrabutylammonium n-butyltriphenyl borate represented by the foregoing Formula (3). Examples of the wax shown in Table 1 include polypropylene wax supplied by SANYO CHEMICAL INDUSTRIES, LTD., and as an example VISCOL 550P (trade name) was used.

rizable toner prior to the illumination with the near infrared rays, and measured the surface temperatures of the sheets and the periods of the illumination with the near infrared rays required for completing the decolorization.

FIG. 1 is a diagram of a decolorizing apparatus for a decolorizing method which was used in the above-mentioned measurement. This measurement was conducted using the apparatus of FIG. 1 placed in a darkroom. In the apparatus, a cylindrical heat insulated cover 153, which opens upwardly is hermetically disposed on a heater 133, and a transparent heat resisting glass plate 154 is hermetically fixed to the opening of the heat insulated cover 153, thereby forming an internal space 155 hermetically sealed from the exterior. A sheet 106 on which the toner image consisting of the photochemically decolorizable toner is formed, is placed on a supporting plate 152, which is disposed on the heater 133 and made of a heat insulating material, and then heated by the heater 133. A light source 135 such as a tungsten halogen lamp is disposed above the sheet 106.

In the apparatus, the heater 133 heats the air in the internal space 155, and the heated air in turn heats the sheet 106. The temperature of the sheet 106, i.e. the temperature of the internal space 155 is measured by a thermometer 156 which protrudes through the heat insulated cover 153 into the internal space 155.

The procedure of the experiment of decolorizing the toner on the sheet 106 using the apparatus of FIG. 1 will be described. First, the heater 133 heats the air in the internal space 155, and the temperature of the internal space 155 measured by the thermometer 156 is set as a predetermined temperature. When the temperature of the internal space 155 reaches the predetermined temperature, this state is maintained for about 5 minutes, and then the light source 135 illuminates the sheet 106 with near infrared rays. Used as the decolorizable toner and the sheet 106 were the toners S1 to S6 listed in Table 1 in the form of developers, obtained by respectively mixing the toners with the above-mentioned carrier, and sheets that were the aforesaid copy paper on which a toner image had been formed by the laser beam printer.

Figure 2:
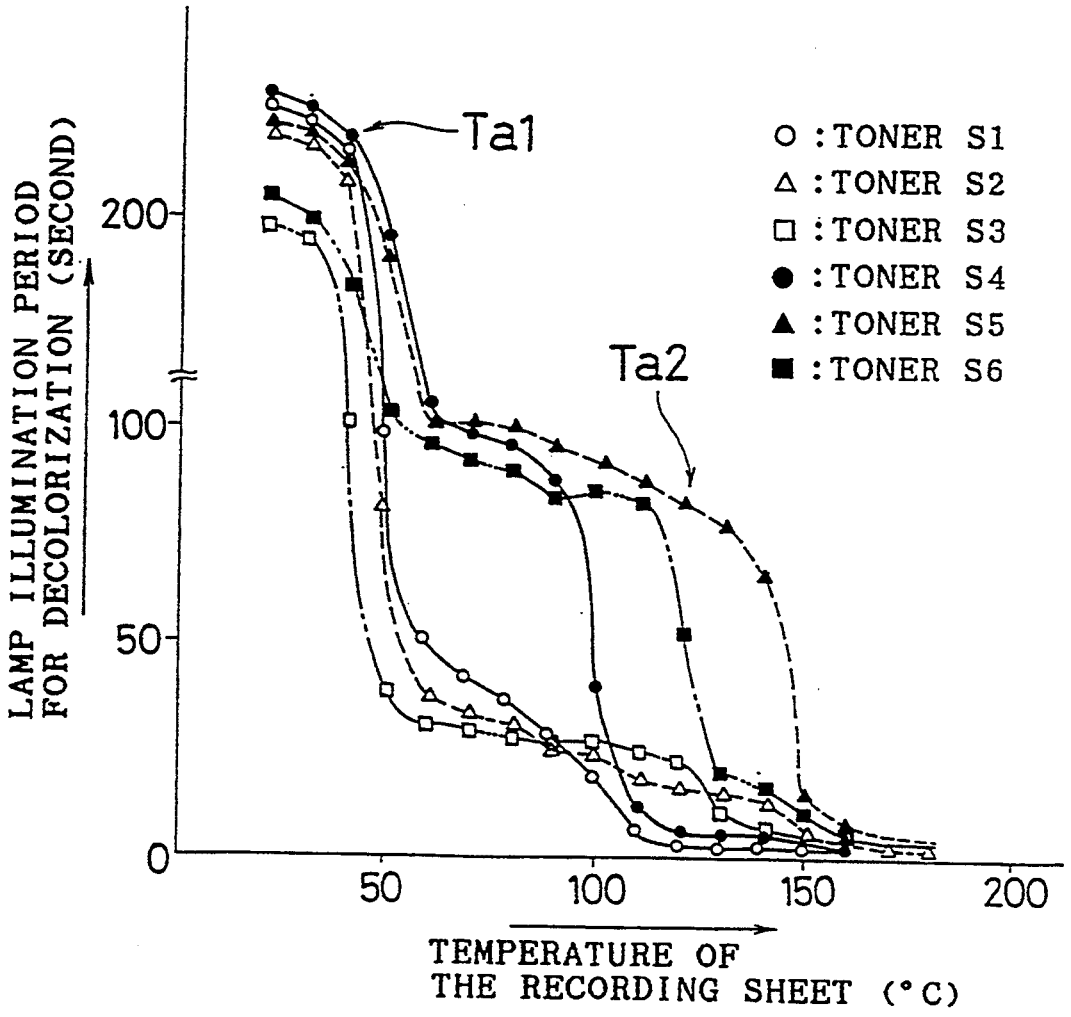
FIG. 2 is a graph illustrating experimental results.

A tungsten halogen lamp of the aluminum coat type which emits near infrared rays was used as the light source 135, and the illumination was conducted at the rating of the lamp, 15 volts and 150 watts. The results obtained in these measurements are shown in the graph of FIG. 2. In this experiment, the completion of decolorization was judged by ten observers. The shortest period until six among the ten observers judged decolorization to be completed was determined as the period required for the completion of decolorization. This shortest period was set as the illumination period required for decolorization. The softening point MP of the toners was measured in accordance with Japanese Industrial Standard JIS K-2207 (1990) "Ring and ball method", and the measurement of the glass-transition temperature was performed using a thermal analyzer (DSC) by the measuring method specified in a U.S. standard, ASTM D3418-82.

As seen from FIG. 2, there exists in the vicinity of 50° to 60° C. a changing point Ta1 at which the lamp illumination period required for decolorization rapidly decreases. After this point, the illumination period gradually changes with the rise of the temperature, to form in the vicinity of about 100° to 150° C. a second changing point Ta2 at which the lamp illumination period rapidly decreases again. The changing point Ta1 is caused by the glass-transition temperature TG of the binding resin used in the toners, and the changing point Ta2 is caused by the softening point MP of the binding resin. Namely, FIG. 2 shows the phenomenon in which the decolorizing reaction rapidly proceeds at the time when the binding resin reaches a rubber-like elastic state, and then the decolorizing reaction at the rubber-like elastic state saturates, and the binding resin melts to fluidity, whereby the decolorizing reaction again proceeds at a high speed.

From the experimental results described above, it will be noted that it is effective in improving the rate of decolorization to perform the decolorizing method comprising the steps of heating a toner image formed on a sheet from a photochemically decolorizable toner, at least to a temperature equal to or higher than the glass-transition temperature of a binding resin of the toner and illuminating the heated toner with near infrared rays.

Second Embodiment

When a toner image formed from the photochemically decolorizable toner having the structure described above is to be decolorized, the toner image is heated to a temperature equal to or higher than the glass-transition temperature TG of the binding resin such as the aforesaid styrene resin of the toner. More preferably, the toner image is heated to a temperature which is equal to or higher than the softening point MP of the binding resin and lower than the decomposition temperatures of the near infrared ray-absorbing pigment constituting the toner. The decomposition temperature of the near infrared ray-absorbing pigment of Formula (1) is about 140° C., and that of the pigment of Formula (2) is about 180° C. When heated to a temperature equal to or higher than the glass-transition temperature TG, the binding resin transfers from a solid state to a rubber-like elastic state, and, when heated to a temperature equal to or higher than the softening point MP, it transfers to a melting state. The toner is further subjected to physical deformation such as rubbing and pressing. When the toner under heating and application of physical deformation is illuminated with near infrared rays, photochemical decolorization of the toner due to the illumination of near infrared rays is performed rapidly. Experiments were conducted to confirm the degree of the reduction in the period required for decolorization according to the invention.

Figure 3:
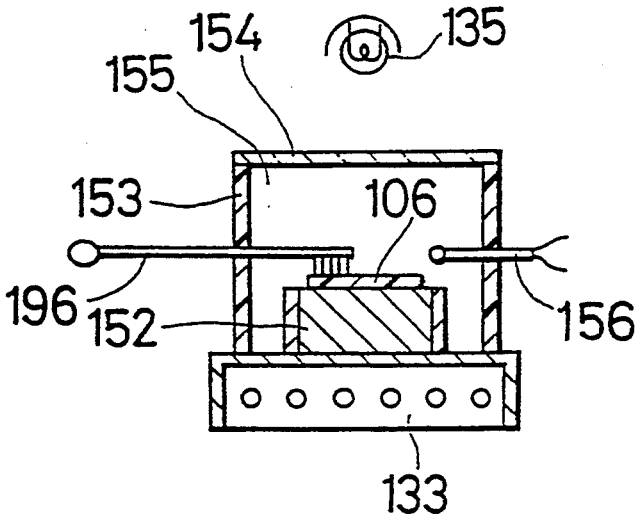
FIG. 3 a sectional view showing the configuration of a decolorizing apparatus for a decolorizing method.

FIG. 3 is a diagram of a decolorizing apparatus for a decolorizing method used in such experiments. This measurement was conducted using the apparatus of FIG. 3 placed in a darkroom. In the apparatus, a cylindrical heat insulated cover 153, which opens upward, is hermetically disposed on a heater 133, and a transparent heat resisting glass plate 154 is hermetically fixed to the opening of the heat insulated cover 153, thereby forming an internal space 155 which is hermetically sealed from the exterior. A sheet 106 on which the toner image, consisting of the photochemically decolorizable toner, is formed is placed on a supporting plate 152 which is disposed on the heater 133 and made of a heat insulating material, and then heated by the heater 133. A light source 135, such as a tungsten halogen lamp, is disposed above the sheet 106.

In the apparatus, the heater 133 heats the air in the internal space 155, and the heated air in turn heats the sheet 106. The temperature of the sheet 106, i.e. the temperature of the internal space 155 is measured by a thermometer 156 which protrudes through the heat insulated cover 153 into the internal space 155.

The procedure of the experiment of decolorizing the toner on the sheet 106 using the apparatus of FIG. 3 will be described. At first, the heater 133 heats the air in the internal space 155, and the temperature of the internal space 155 measured by the thermometer 156 is set as a predetermined temperature. When the temperature of the internal space 155 reaches the predetermined temperature, this state is maintained for about 5 minutes, and then the light source 135 illuminates the sheet 106 with near infrared rays. At this time, the surface of the sheet 106 is rubbed by a brush member 196 having a front end to which heat resisting fibers are implanted, at a rate of, for example, one cycle per second.

A tungsten halogen lamp of the aluminum coat type, which emits near infrared rays, is used as the light source 135, and the illumination is conducted at the rating of the lamp, 15 volts and 150 watts.

The results obtained in these measurements are shown in Table 2. In these experiments, the completion of decolorization was judged by ten observers. The shortest period until six among the ten observers judged decolorization to be completed was determined as the period required for the completion of decolorization. This shortest period was set as the illumination period required for decolorization. The softening point MP and glass-transition temperature were measured in the same manner as described above.

TABLE 2

| | Compound No. of decolorizable toner | Glass -transition temperature of binding resin (°C.) | Softening point of binding resin (°C.) | Temperature of recording sheet (°C.) | Physical deformation (Yes or No) | Near IR ray illumination period required for decolorization (sec.) |
|---|---|---|---|---|---|---|
| Example | | | | | | |
| 1 | S1 | 60 | 104 | 60 | Yes | 24 |
| 2 | S1 | 60 | 104 | 110 | Yes | 4 |
| 3 | S2 | 58 | 145 | 100 | Yes | 9 |
| 4 | S3 | 50 | 125 | 130 | Yes | 5 |
| 5 | S4 | 60 | 104 | 110 | Yes | 10 |
| 6 | S5 | 58 | 145 | 60 | Yes | 47 |
| 7 | S5 | 58 | 145 | 100 | Yes | 37 |
| 8 | S5 | 58 | 145 | 145 | Yes | 15 |
| 9 | S6 | 50 | 125 | 130 | Yes | 14 |
| Comparative Example | | | | | | |
| 1 | S1 | 60 | 104 | 40 | No | 185 |
| 2 | S1 | 60 | 104 | 60 | No | 58 |
| 3 | S1 | 60 | 104 | 110 | No | 11 |
| 4 | S2 | 58 | 145 | 100 | No | 25 |
| 5 | S2 | 58 | 145 | 150 | No | Pigment was decomposed to become yellow |
| 6 | S3 | 50 | 125 | 40 | No | 180 |
| 7 | S3 | 50 | 125 | 130 | No | 15 |
| 8 | S4 | 60 | 104 | 40 | No | 218 |
| 9 | S4 | 60 | 104 | 110 | No | 20 |
| 10 | S5 | 58 | 145 | 40 | No | 220 |
| 11 | S5 | 58 | 145 | 60 | No | 110 |
| 12 | S5 | 58 | 145 | 100 | No | 75 |
| 13 | S5 | 58 | 145 | 145 | No | 30 |
| 14 | S6 | 50 | 145 | 40 | No | 210 |
| 15 | S6 | 50 | 125 | 130 | No | 25 |

As is apparent from Table 2, the rate of decolorization when the temperature of the sheet is equal to or higher than the glass-transition temperature of the binding resin of the toner is substantially greater than that when the temperature of the sheet is lower than the glass-transition temperature of the binding resin.

An object of the invention is to further improve the rate of decolorization. Examples 1 to 9 show the rate of decolorization obtained when the surface of the recording sheet was rubbed by the brush member 196. It will be noted that the rate of decolorization is remarkably improved in all cases of using the decolorizable toners S1 to S6, i.e., irrespective of the kind of toner (Table 1), as compared with Comparative Examples 1 to 15.

From the above-mentioned experimental results, it will be noted that it is effective in further improving the rate of decolorization to heat the decolorizable toner to a temperature equal to OF higher than the glass-transition temperature of a binding resin of the toner, more preferably the softening point of the binding resin, and to then illuminate the heated toner with near infrared rays while applying a physical deformation such as rubbing and pressing.

Furthermore, the decolorizing reaction is realized by an irreversible chemical reaction, so that decolorized toner images on the sheet 106 are prevented from being unwillingly changed to a colored state or discolored depending on the ambient temperature, illumination or non-illumination with the usual white light or chemical conditions.

Third Embodiment

Experiments relating to the decolorizing method of the invention were conducted in the manner described below. A recording sheet on which an image of the above-mentioned decolorizable toner had been formed in a thickness of about 35 μm was used. The toner image was shaved off to a thickness of about 10 μm by an abrasive member such as sandpaper, in a manner described later, and then illuminated with near infrared rays. In this case, the near infrared ray illumination period was measured until the toner image on the sheet was completely decolorized.

In other experiments, heating rollers heated to about 110° to 130° C. were pressed to the surface of a recording sheet having a toner layer of a thickness of about 35 μm so that the toner image was reversely transferred to the heating rollers, thereby reducing the thickness of the toner layer of the sheet to about 15 μm.

Immediately after the toner image was reversely transferred from a sheet to a heating rollers, the sheet was illuminated with near infrared rays, and the illumination period was measured until the toner image on the sheet was completely decolorized. The thickness of the toner layer on the sheet was measured by cutting the sheet together with the toner layer and observing the section through a microscope. These experiments relating to the decolorizing method of the invention were conducted using the experimental apparatus shown in FIGS. 4 and 5 placed in a darkroom.

Figure 4:
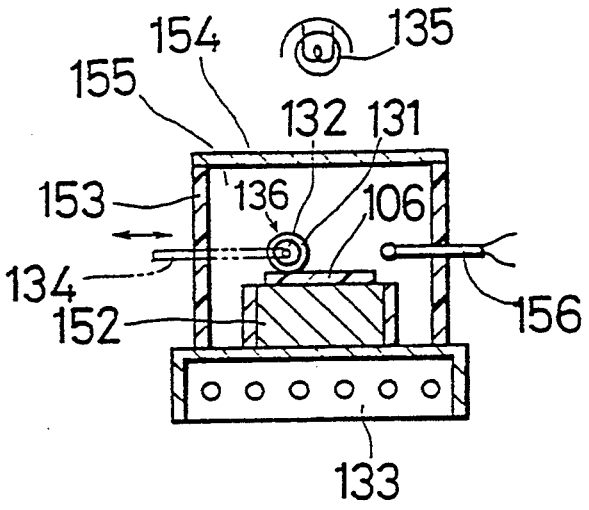
FIG. 4 is a sectional view showing the configuration of a decolorizing apparatus for a decolorizing method.

FIG. 4 is a diagram of the decolorizing apparatus for a decolorizing method used in the above-mentioned measurement. In the apparatus, a cylindrical heat insulated cover 153 which opens upward is hermetically disposed on a heater 133, and a transparent heat resisting glass plate 154 is hermetically fixed to the opening of the heat insulated cover 153, thereby forming an internal space 155 hermetically sealed from the exterior. A sheet 106 on which the toner image, consisting of the photochemically decolorizable toner is formed is placed on a supporting plate 152, which is disposed on the heater 133 and made of a heat insulating material. A processing member 136 has a cylindrical body 132 which is supported by a supporting piece 134. An abrasive material 131 such as sandpaper is attached on the outer periphery of the cylindrical body. While being supported by the supporting piece 134, the processing member 136 can reciprocate on the sheet 106 in the direction indicated by the arrow so as to abrade and remove the toner layer on the sheet 106. After this processing, the sheet 106 is heated by the heater 133. A light source 135, such as a tungsten halogen lamp, is disposed above the recording sheet 106.

In the apparatus, the heater 133 heats the air in the internal space 155, and the heated air in turn heats the sheet 106. The temperature of the sheet 106, i.e., the temperature of the internal space 155, is measured by a thermometer 156 which protrudes through the heat insulated cover 153 into the internal space 155.

The procedure of decolorizing the toner on the sheet 106 using the decolorizing apparatus of FIG. 4 will be described. Initially, the processing member 136 abrades the toner layer on the sheet 106. Then, the heater 133 heats the air in the internal space 155, and the temperature of the internal space 155 measured by the thermometer 156 is set as a predetermined temperature. When the temperature of the internal space 158 reaches the predetermined temperature, this state is maintained for about 5 minutes, and then the light source 135 illuminates the sheet 106 with near infrared rays. A tungsten halogen lamp of the aluminum coat type, which emits near infrared rays, is used as the light source 135, and the illumination is conducted at the rating of the lamp, 15 volts and 150 watts.

Figure 5:
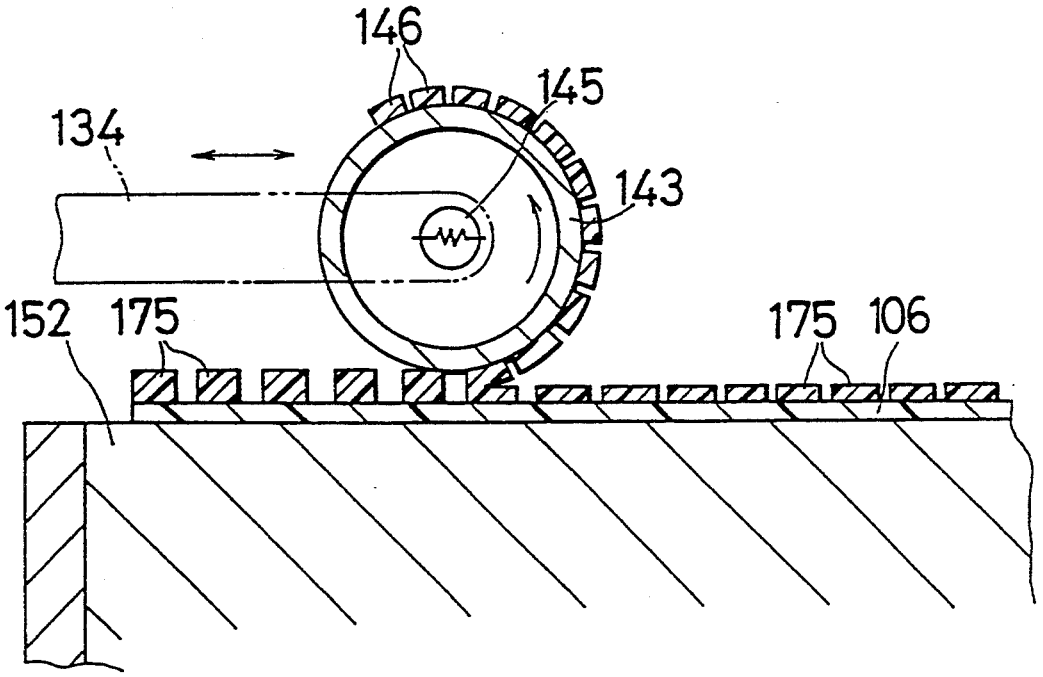
FIG. 5 is a sectional view showing the configuration of a decolorizing apparatus for a decolorizing method.

FIG. 5 is an enlarged sectional view of a decolorizing apparatus for a decolorizing method. This decolorizing apparatus is similar in structure to that of FIG. 4, and the corresponding portions are designated by the same reference numerals. The decolorizing apparatus of FIG. 5 is characterized in that the decolorizing apparatus of FIG. 4 is modified so that the processing member 136 comprises a metal reverse-transfer roller 143, having a built-in heat source 145 such as a lamp or a heater, and that the toner image on the sheet 106 is melted by the heat of the heat source 145 while the reverse-transfer roller 143 is held by the supporting piece 134. The reverse transfer in this context means a process in which a toner layer transferred onto the sheet 106 is heated to a temperature equal to or higher than the glass-transition temperature TG so as to achieve at least a rubber-like elastic state, preferably a melting state, and the toner in this state is transferred to a belt, roller or the like.

When the reverse-transfer roller 143 is rotated on the sheet 106, melting toner 175 adheres to the surface of the reverse-transfer roller 143 to form a reverse transfer layer 146 thereon. In this way, the toner 175 on the sheet 106 is peeled off and removed so that the thickness of the toner layer is reduced prior to the illumination with the near infrared rays.

In the decolorizing procedure using the decolorizing apparatus of FIG. 5, which is substantially the same as that using the decolorizing apparatus of FIG. 4, the toner 175 is reversely transferred with the reverse-transfer roller 143. Namely, the surface layer portion of the toner layer is peeled off and removed from the sheet 106, and then the above-mentioned heating process and the near infrared ray illumination process are performed by the heater 133 and the light source 135, respectively.

The embodiment of this decolorizing method can achieve the same effects as described in conjunction with the foregoing embodiments.

The results obtained from measurements using the toners S7 to S10 listed in Table 1 are shown in Table 3. In these experiments, the completion of decolorization was judged by ten observers. The shortest period until six among the ten observers judged decolorization to be completed was determined as the period required for the completion of decolorization. This shortest period was set as the illumination period required for decolorization.

TABLE 3

| | Compound No. of decolorizable toner | Sheet to be decolorized: Thickness of toner layer (μm) | Sheet to be decolorized: Process of removing toner | Sheet to be decolorized: Temp. at illumination of near IR rays (°C.) | Near IR ray illumination period required for decolorization (sec) | Inconspicuousness of decolorized toner |
|---|---|---|---|---|---|---|
| Example | | | | | | |
| 10 | S7 | About 10 | Abrasion | 60 | 44 | ○ |
| 11 | S7 | About 10 | Abrasion | 110 | 8 | ○ |
| 12 | S7 | About 15 | Reverse transfer | 110 | 10 | ○ |
| 13 | S8 | About 10 | Abrasion | 60 | 48 | ○ |
| 14 | S8 | About 10 | Abrasion | 130 | 10 | ○ |
| 15 | S8 | About 15 | Reverse transfer | 130 | 8 | ○ |
| 16 | S9 | About 10 | Abrasion | 60 | 84 | ○ |

TABLE 3-continued

| | Compound No. of decolorizable toner | Sheet to be decolorized: Thickness of toner layer (μm) | Sheet to be decolorized: Process of removing toner | Sheet to be decolorized: Temp. at illumination of near IR rays (°C.) | Near IR ray illumination period required for decolorization (sec) | Inconspicuousness of decolorized toner |
|---|---|---|---|---|---|---|
| 17 | S9 | About 10 | Abrasion | 110 | 22 | ○ |
| 18 | S9 | About 15 | Reverse transfer | 110 | 22 | ○ |
| 19 | S10 | About 10 | Abrasion | 60 | 88 | ○ |
| 20 | S10 | About 10 | Abrasion | 130 | 19 | ○ |
| 21 | S10 | About 15 | Reverse transfer | 130 | 20 | ○ |
| Comparative Example | | | | | | |
| 16 | S7 | About 35 | No | 60 | 75 | X |
| 17 | S7 | About 35 | No | 110 | 17 | X |
| 18 | S8 | About 35 | No | 60 | 65 | X |
| 19 | S8 | About 35 | No | 130 | 20 | X |
| 20 | S9 | About 35 | No | 60 | 130 | X |
| 21 | S9 | About 35 | No | 110 | 36 | X |
| 22 | S10 | About 35 | No | 60 | 120 | X |
| 23 | S10 | About 35 | No | 130 | 30 | X |

It will be noted from Table 3 that, when the toner layer of the sheet having a thickness of about 35 μm is thinned by the abrasion process as in Examples 10, 11, 13, 14, 16, 17, 19 and 20 so as to have a thickness of about 10 μm, the period with the illumination of near infrared rays required for complete decolorization is remarkably shortened as compared with that required when the thickness of the toner layer decolorized remains to be about 35 μm. Similarly, when the thickness of the toner layer on the sheet 106 is reduced by the above-mentioned reverse transfer process as in Examples 12, 15, 18 and 21, period of the illumination with the near infrared rays required for complete decolorization is remarkably shortened as compared with that required when the thickness of the toner layer to be decolorized remains about 35 μm.

When the inconspicuousness of the toner print portion on the decolorized sheet 106 having a toner layer thickness of about 35 μm is compared with that of the toner print portion having a toner layer thickness of about 10 to 15 μm, it will be noted that the toner print portion having a toner layer thickness of about 10 to 15 μm is more inconspicuous. The estimate of the inconspicuousness was conducted, for example, in such a manner that the toner print portion after being subjected to the decolorizing process was observed with the naked eye, and, when the rising of the toner layer was obviously recognized, this decolorization was judged to be a failure and indicated by "X", and, when the rising of the toner layer was not obviously recognized, this decolorization was judged to be a success and indicated by "O" in the table.

It will be noted from the above that the decolorized toner print portion can be made inconspicuous by abrading the toner layer on the sheet 106 or performing the reverse transfer so that the toner layer is partially removed, at least in the thickness direction, to reduce the thickness of the toner layer.

According to the embodiment, when a toner image formed from a decolorizable toner is to be decolorized, the toner layer on the sheet is partially removed in the thickness direction prior illumination with the near infrared rays, and thereafter near infrared rays are illuminated, whereby the rate of decolorization in the deep portion of the toner layer is improved. Since the toner is decolorized with the thickness of the toner layer reduced, it is possible to make traces of the decolorized toner image inconspicuous.

The decolorizing method of the invention is not restricted to the examples in which a toner layer on the sheet 106 having a thickness of about 35 μm is thinned to have a thickness of about 10 μm in such a manner as described in the embodiment. Namely, the invention includes a wide range of modifications in which, irrespective of the thickness of a toner layer on the sheet 106, the surface portion of toner layer is removed by performing the shaving, peeling or the like, and then the thinned toner layer is subjected to illumination with the near infrared rays.

Fourth Embodiment

Figure 6:
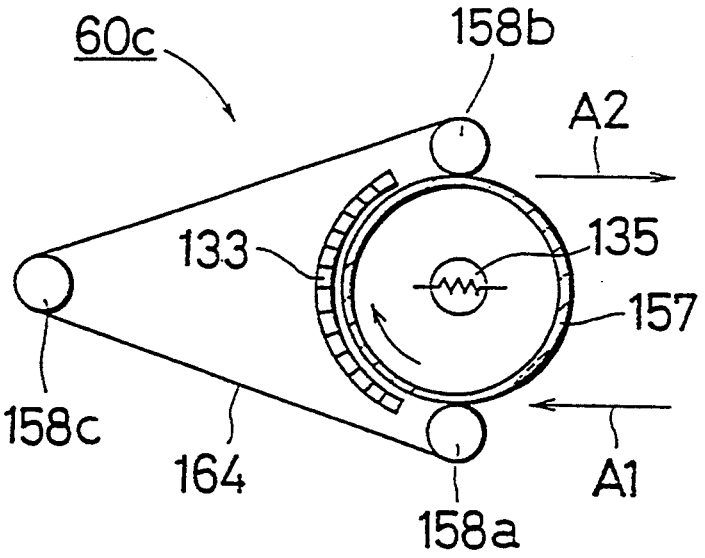
FIG. 6 is a sectional view showing the configuration of a decolorizing apparatus 60*c* for a decolorizing method.

FIG. 6 is a sectional view of a decolorizing apparatus 60*c* for a decolorizing method in which, when the sheet 106 is to be decolorized, the heating and the illumination with the near infrared rays are simultaneously performed. A light source 135 for illuminating with the near infrared rays is disposed inside a roller 157, which is made of transparent glass. A pair of rollers 158*a* and 158*b* are disposed in the vicinity of the roller 157 a distance from each other along the peripheral direction of the roller 157. Another roller 158*c* is disposed at a position which is separated from the roller 157. A belt 164 for transporting the sheet 106 is wound around the rollers 158*a*, 158*b* and 158*c* so that the portion of the belt 164 between the rollers 158*a* and 158*b* elongates along and contacts with the roller 157 made of transparent glass. In the vicinity of the portion of the belt 164 contacting the roller 157 is disposed a heater 133. The roller 157 and the belt 164 are driven in such a manner that their peripheral velocities are different from each other.

The sheet which has been transported in the direction of arrow A1, is further transported while being sandwiched between the belt 164 and the roller 157 and heated by the heater 133 during this transportation. At the same time, the sheet 106 is rubbed or subjected to physical deformation due to the difference in peripheral velocity between the belt 164 and the roller 157. During this deformation, the light source 135 inside the roller 157 illuminates the sheet through the roller 157 with near infrared rays, thereby performing the decolorization process. The decolorized sheet is then transported in the direction of arrow A2.

Fifth Embodiment

Figure 7:
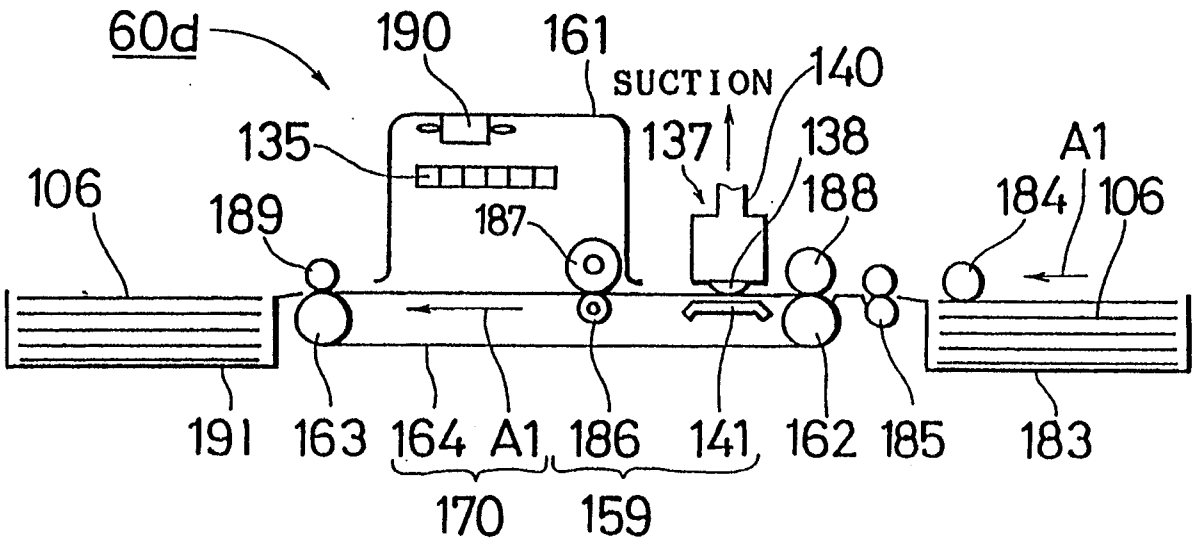
FIG. 7 is a sectional view showing the configuration of a decolorizing apparatus 60*d* for a decolorizing method.
Figure 8:
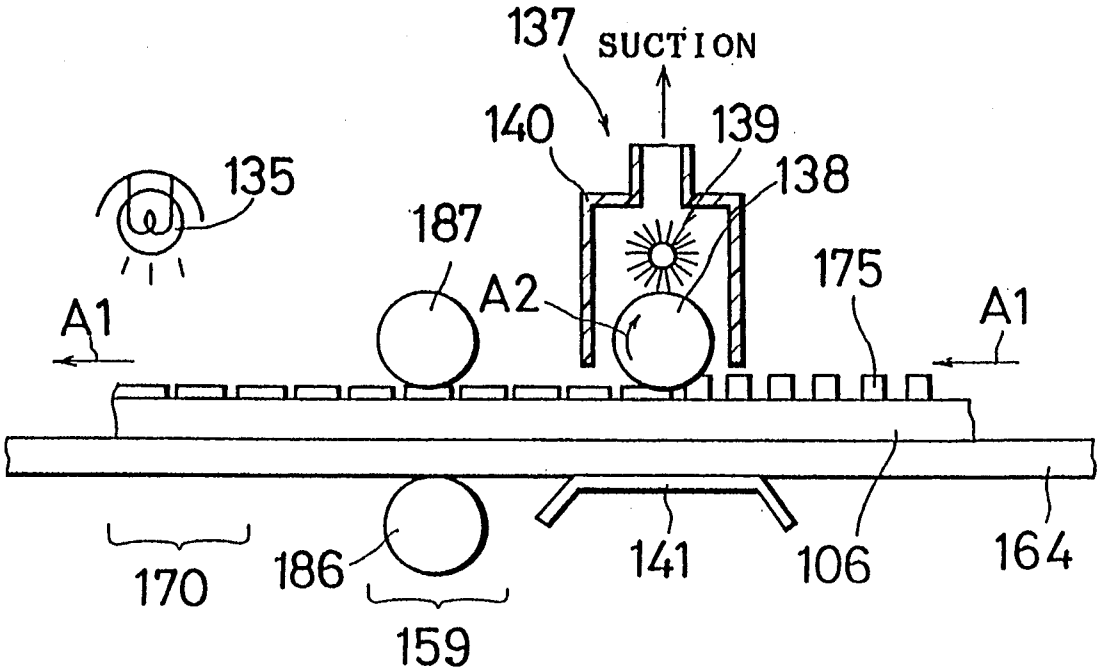
FIG. 8 is an enlarged sectional view of the vicinity of an abrasive roller 138 shown in FIG. 7.

FIG. 7 is a sectional view of a decolorizing apparatus 60*d* for a decolorizing method and FIG. 8 is an enlarged sectional view of the decolorizing apparatus 60*d*. The decolorizing apparatus 60*d* comprises a tray 183 on which sheets 106 to be decolorized are stacked. The sheets 106 on the tray 183 are taken out by a sheet supply roller 184 and supplied by resist rollers 185 to an endless belt 164 for transporting the sheet 106. A processing device 137 is disposed at the upstream end of the endless belt 164 with respect to the direction A1 along which the sheet 106 is transported. The processing device 137 comprises a duct 140 which covers the entire width of the endless belt 164 and opens downwardly. An abrasive roller 138, which has a toughened outer surface, or to which sandpaper is fixed is disposed inside the duct 140 and positioned in such a manner that the roller can abrade the toner layer 175 on the sheet 106 to a layer thickness of about 10 μm. The abrasive roller 138 is rotated in the direction of arrow A2.

A cleaning brush 139 is disposed inside the duct 140 and positioned in such a manner that the brush 139 slidingly contacts with the outer surface of the abrasive roller 138. In order to remove the toner adhered to the abrasive roller 138, the cleaning brush 139 has a cylindrical member on which electrically insulating fibers are implanted. The air in the duct 140 is sucked from the outside to provide a negative pressure. Therefore, the toner which has been removed from the abrasive roller 138 by the cleaning brush 139 is pulled outside by the suction and then collected by a dust collector (not shown). A supporting member 141 is positioned in such a manner that the endless belt 164 and the sheet 106 are pressed between this member 164 and the abrasive roller 138.

A heating unit 159, which comprises a heat insulated wall 161 made of a heat insulating material, is disposed on the downstream side of the processing device 137 in the direction A1 of transporting the sheet 106. The endless belt 164 extends between a pair of rollers 162 and 163 and runs under the heat insulated wall 161. A press roller 186 is disposed in the space surrounded by the endless belt 164 and between the pair of rollers 162 and 163, and a heating roller 187 is disposed at a position opposite to the press roller 186 against the endless belt 164, whereby the sheet 106 is sandwiched between the rollers 186 and 187 and is heated at least to a temperature equal to or higher than the glass-transition temperature TG, and preferably to the softening point MP of the binding resin of the toner, so that the toner which is at least in a rubber-like elastic state is spread out.

Transporting rollers 188 and 189, which are respectively disposed on the rollers 162 and 163, transport the sheet 106 in collaboration with the endless belt 164. A light source 135 is disposed inside the heat insulated wall 161. A fan 190 is disposed above the light source 135 so that the sheet 106 on the endless belt 164 is illuminated with near infrared rays from the light source 135 while being pressed down toward the endless belt 164. The decolorized sheet 106 is stacked on a tray 191.

The embodiment can achieve the same effects as those described in conjunction with the foregoing embodiments of the decolorizing method.

Sixth Embodiment

Figure 9:
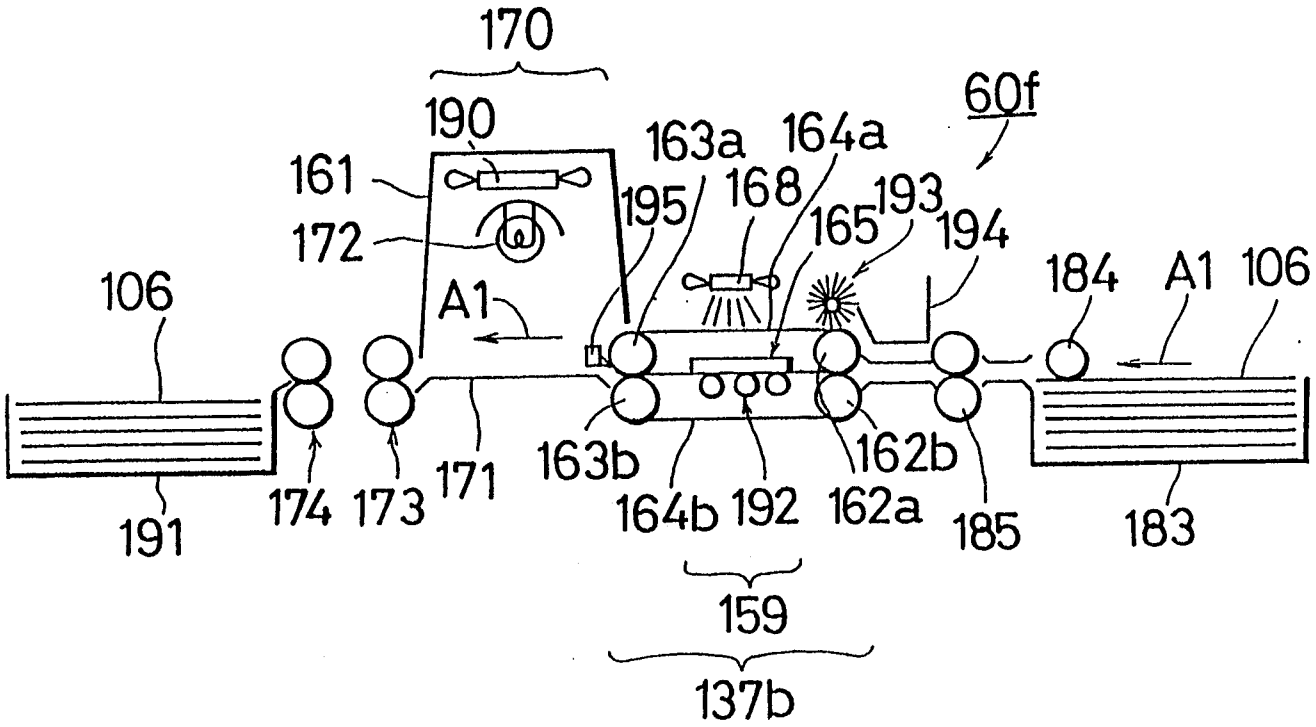
FIG. 9 is a sectional view showing the configuration of a decolorizing apparatus 60*f* for a decolorizing method.

FIG. 9 is a sectional view of a decolorizing apparatus 60*f* for a decolorizing method. This embodiment is similar in structure to the embodiment shown in FIG. 7, and corresponding portions are designated by the same reference numerals. The decolorizing apparatus 60*f* comprises, downstream of the resist rollers 185, a pair of endless belts 164*a* and 164*b* for transporting a sheet 106, which extend between respective pairs of rollers 162*a* and 163*a*, and 162*b* and 163*b*. A heater 165 is disposed in the space surrounded by the endless belt 164*a* and between the pair of rollers 162*a* and 163*a*. Inside the endless belt 164*b* and between the rollers 162*b* and 163*b*, are disposed a plurality of press rollers 192 which press the endless belt 164b against the heater 165 through the endless belt 164*a*. A fan 168 for cooling melted toner which adheres to the endless belt 164*a* to solidify the toner is disposed above the endless belt 164*a*.

Since the toner image on the sheet 106 is heated by the heater 165 to achieve a rubber-like elastic state or to melt, the endless belt 164*a* is provided with a brush-like cleaning member 193 which is rotated to remove the toner adhering to the endless belt 164*a*. The waste toner which has been removed by the cleaning member 193 is stored in a storage tank 194. A separating claw 195 for separating the sheet 106 from the endless belt 164*a* is disposed in contact from the outside, with the portion of the endless belt 164*a* which contacts with the roller 163*a*.

An illumination unit 170 which illuminates the sheet 106 with light, including the above-mentioned near infrared rays is disposed downstream of the endless belts 164*a* and 164*b* in the transporting direction A1 of the sheet 106. The illumination unit 170 comprises a light source 172 disposed inside a heat insulated wall 161. A platform 171 is disposed below the light source 172. A pair of fixing rollers 173 are disposed downstream of the platform 171 the transporting direction A1. The decolorized toner remaining on the sheet 106 is pressed between the pair of fixing rollers 173 to be extended over the entire surface of the sheet 106, whereby the surface of the sheet 106 is made relatively smooth. Downstream of the fixing rollers 173 in the transporting direction are disposed a pair of discharging rollers 174 that discharge the sheet 106 on which toner images have been decolorized to the outside of the decolorizing apparatus 60*f*. The discharged sheet 106 is placed on a tray 191.

The embodiment can achieve the same effects as those described in conjunction with the foregoing embodiments.

Seventh Embodiment

Figure 10:
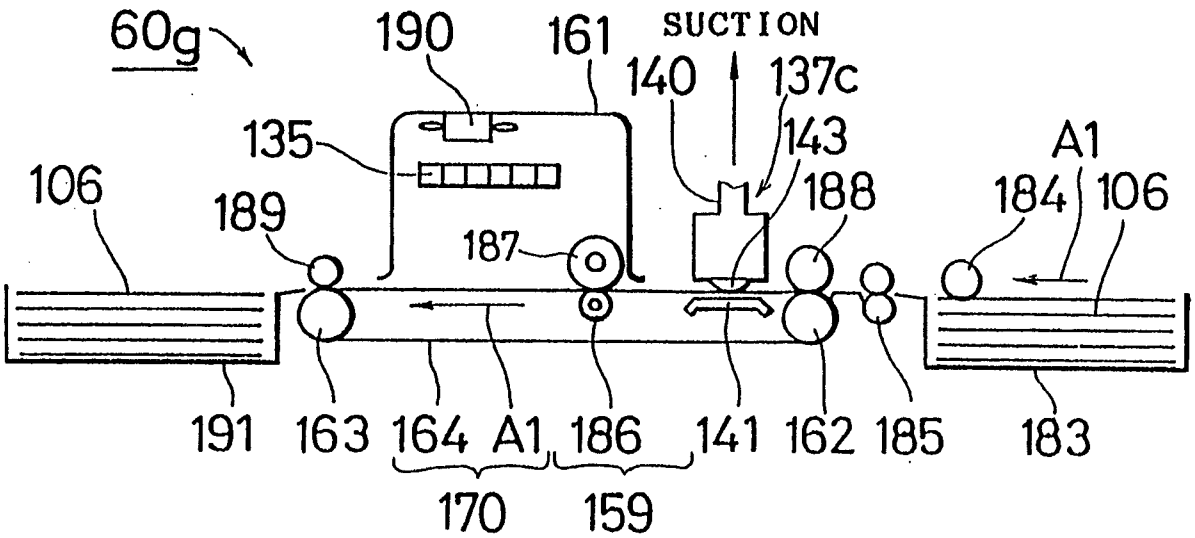
FIG. 10 is a sectional view showing the configuration of a decolorizing apparatus 60*g* for a decolorizing method.
Figure 11:
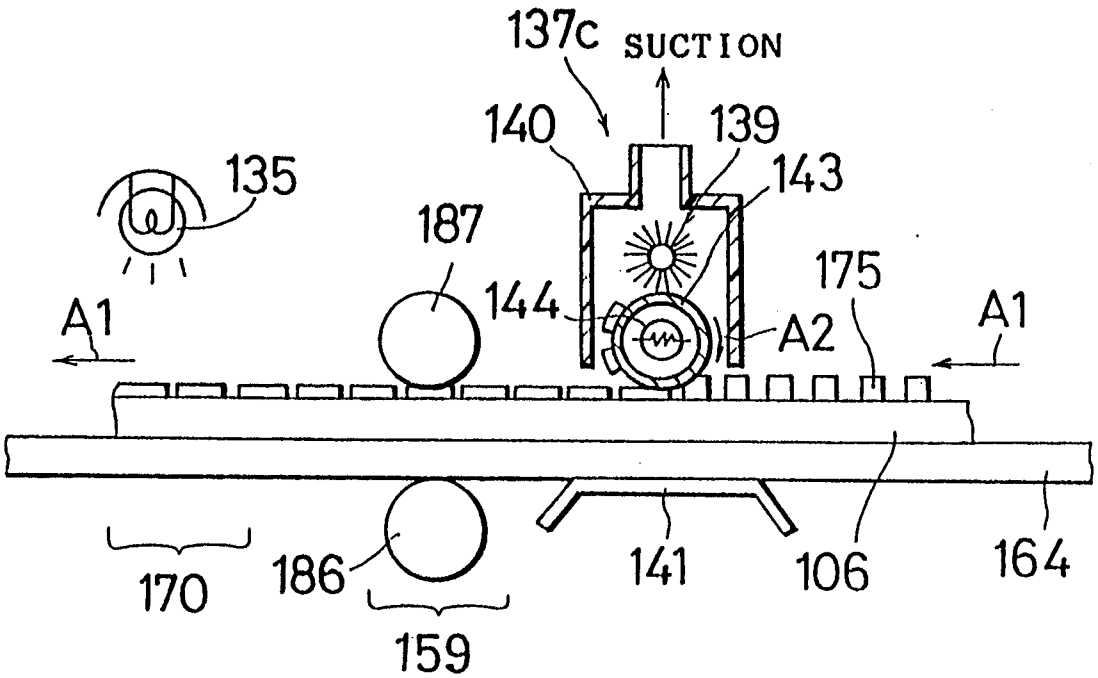
FIG. 11 is an enlarged sectional view of the vicinity of a reverse transfer roller 143 shown in FIG. 10.

FIG. 10 is a sectional view of a decolorizing apparatus 60*g* for a decolorizing method and FIG. 11 is an enlarged sectional view of the decolorizing apparatus 60*g*. This embodiment is similar in structure to the embodiment shown in FIG. 7, and the corresponding portions are designated by the same reference numerals. In the decolorizing apparatus 60*g*, a processing device 137*c* is disposed on the upstream side of an endless belt 164 with respect to the transporting direction A1 of the sheet 106. The processing device 137*c* comprises a duct 140 which covers the entire width of the endless belt 164 and opens downwardly. Inside the duct 140, is disposed a reverse-transfer roller 143, which is rotated in the direction of arrow A2 on an axis parallel to the width direction of the endless belt 164. The reverse-transfer roller 143 incorporates a heater 144, and is formed into a cylindrical shape from a material to which the above-mentioned toner can adhere. A cleaning brush 139, on which electrically insulating fibers are implanted in order to remove the toner on the reverse-transfer roller 143, is disposed inside the duct 140 and positioned that the brush slidingly contacts the reverse-transfer roller 143. The air in the duct 140 is sucked from the outside to provide a negative pressure. Therefore, the toner which has been removed from the surface of the sheet 106 by the cleaning brush 139 is pulled out by the suction and then collected by a dust collector or the like (not shown).

The embodiment can achieve the same effects as those described in conjunction with the foregoing embodiments. Embodiments of the invention include applications in which the configurations of the embodiments shown in FIGS. 7–11 are incorporated in electrostatic copiers to function as a decolorizing device.

Eighth Embodiment

Figure 12:
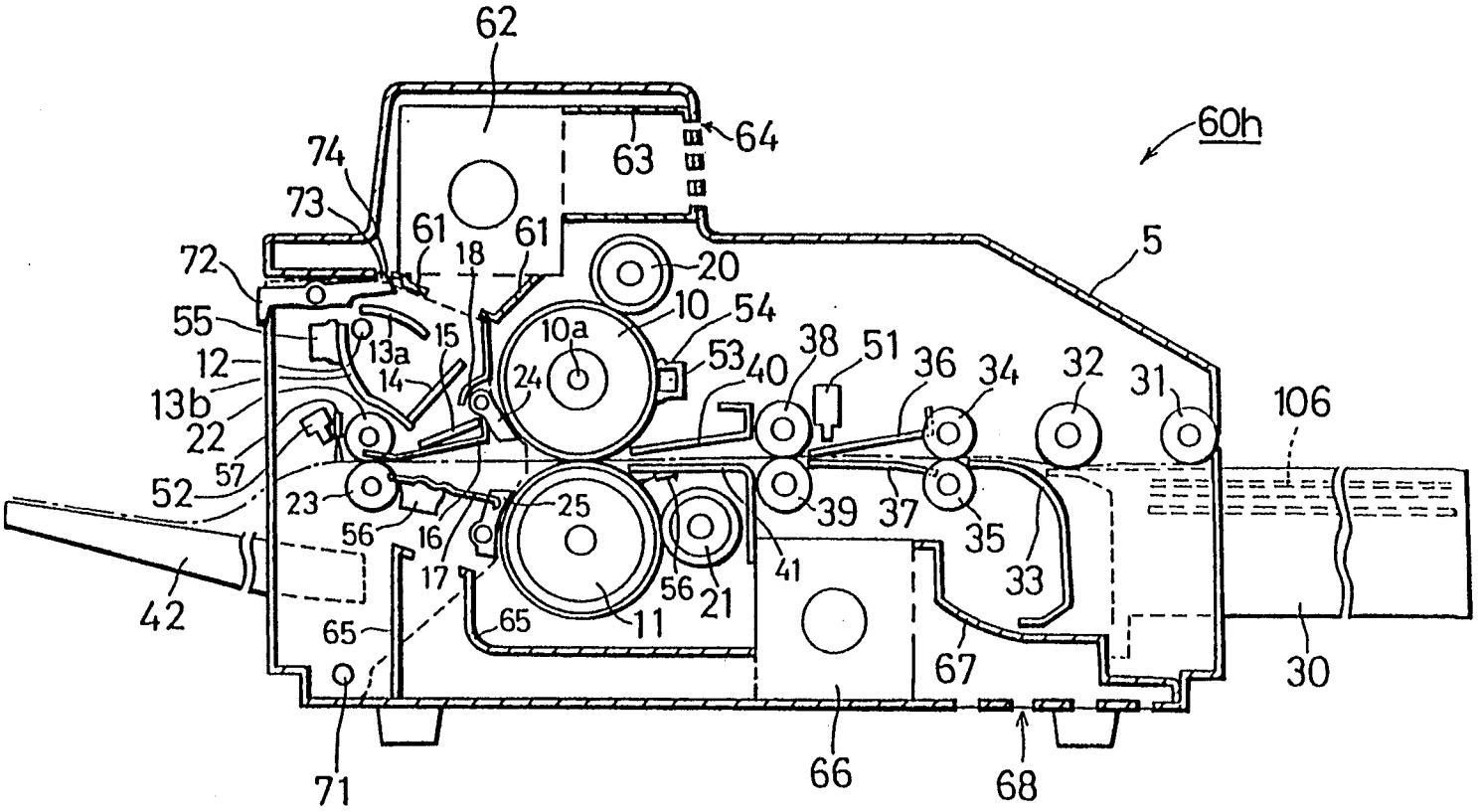
FIG. 12 is a sectional view showing the configuration of a decolorizing apparatus 60*h* for a decolorizing method.

FIG. 12 is a front sectional view showing the configuration of a decolorizing apparatus **60*h* for a decolorizing method. The decolorizing apparatus 60*h* comprises a heating roller pair which consists of a heating roller 10 and a press roller 11, a light source 12 such as a tungsten halogen lamp, reflecting mirrors 13*a* and 13*b* having a concave shape, heat resisting glass plates 14 and 15, supply rollers 31 and 32, transporting rollers 34, 35, 38 and 39 and discharge rollers 22 and 23 which transport a sheet 106 such as paper or plastic sheet, guide members 33, 36, 37, 40, 41, 16 and 17 for smoothly guiding the sheet 106, exhaust ducts 61, 63, 65 and 67 and exhaust fans 62 and 66 which discharge to the outside the heat generated from the heating roller pair 10 and 11 and the light source 12**.

The plural sheets 106 to which the above-mentioned photochemically decolorizable toner is fixed are accommodated in a sheet supply cassette 30. The sheet 106 is taken out by the supply rollers 31 and 32, and then transported along a one-dot chain line in the figure to the heating roller pair 10 and 11 by the guide members 33, 36, 37, 40 and 41 and transporting rollers 34, 85, 38 and 39.

The heating roller 10 is a hollow cylindrical roller which is made of a metal or glass and the surface of which is coated with fluorocarbon polymers or the like. A heater **10*a* such as a tungsten halogen lamp is incorporated in the shaft portion of the roller 10 so that the energization of the heater 10*a* causes the surface to be heated to a predetermined temperature. The press roller 11 is a metal roller with a surface coated with a thick layer of silicone rubber and forced at a predetermined pressure toward the heating roller 10 so that the silicone rubber elastically deforms along the outer shape of the heating roller 10**, thereby maintaining a predetermined contacting area.

When the sheet 106 is transported while being sandwiched between the heating roller pair 10 and 11, the toner is heated to a temperature equal to or higher than its glass-transition temperature of the bonding resin.

On the discharging side of the heating roller pair 10 and 11, light including near infrared rays emitted from the light source 12 is efficiently converged by the reflecting mirrors **13*a* and 13*b*, etc., thereby forming a light condensing portion having a high light illumination density. As soon as discharged from the heating roller pair 10 and 11, therefore, the sheet 106 is illuminated with light of near infrared rays, with the result that the color of the toner is efficiently erased. The decolorized sheet 106 is guided by the guide members 16 and 17 and discharged to the outside by the discharge rollers 22 and 23 to be placed on a discharge tray 42. The guide member 16** consists of a plurality of linear members which are formed by bending wires along the transporting direction of the sheet and are arranged at predetermined intervals perpendicular to the transporting direction of the sheet.

In this way, when the sheet 106, on which images are once formed from the toner, is transported from the sheet supply cassette 30 to the discharge tray 42, the toner image is efficiently and quickly decolorized.

Cleaning rollers 20 and 21 into which a parting agent such as silicone oil is impregnated, respectively contact with the heating roller 10 and the press roller 11 of the heating roller pair, so that the surface of the heating roller pair 10 and 11 is wetted by the parting agent. This prevents the toner fixed to the sheet 106 from adhering to the roller pair and also the sheet 106 from winding round the roller pair. Separating claws 24 and 25 contact the heating roller 10 and the press roller 11 on the discharging side, respectively. Even when the sheet 106 is closely attracted to the heating roller 10 or the press roller 11, the sheet 106 can be separated from the roller by the tip of the separating claw 24 or 25, thereby preventing the sheet 106 from winding a round the roller.

Sheet detection sensors 51 and 52 such as a photocoupler or microswitch are optionally disposed at various positions along the transporting path (indicated by a one-dot chain line in FIG. 12) of the sheet 106, for example at the upper potion of the guide member 36, and on the discharging side of the discharge rollers 22 and 23. These sensors are used in timing control and detection of a jam. Electric discharge brushes 56 and 57 are disposed at various positions along the transporting path of the sheet 106 and of the rollers for example on the surface of the press roller 11 and on the discharging side of the discharge rollers 22 and 23, thereby preventing the sheet 106 from being electrostatically attracted to the rollers.

A temperature sensor 53, such as a bimetal or a thermistor, is disposed on the surface of the heating roller 10 so as to control the temperature of the heating roller 10. Furthermore, thermal fuses 54, 55 and 56 are disposed at positions where the temperature rise is notable, for example on the surface of the heating roller 10, the reflecting mirror 13b and the guide member 17, thereby preventing the generation of an abnormal high temperature.

A large amount of heat is generated in the vicinity of the heating roller pair 10 and 11 and the light source 12. Therefore, exhaust ducts 61 and 65 are disposed at the both sides of the transporting path of the sheet 106, and the air is forcedly exhausted to the outside by the exhaust fans 62 and 66, such as sirocco fans through the exhaust ducts 63 and 67 and vent holes 64 and 68, thereby preventing an excessive temperature rise of the apparatus.

Figure 13:
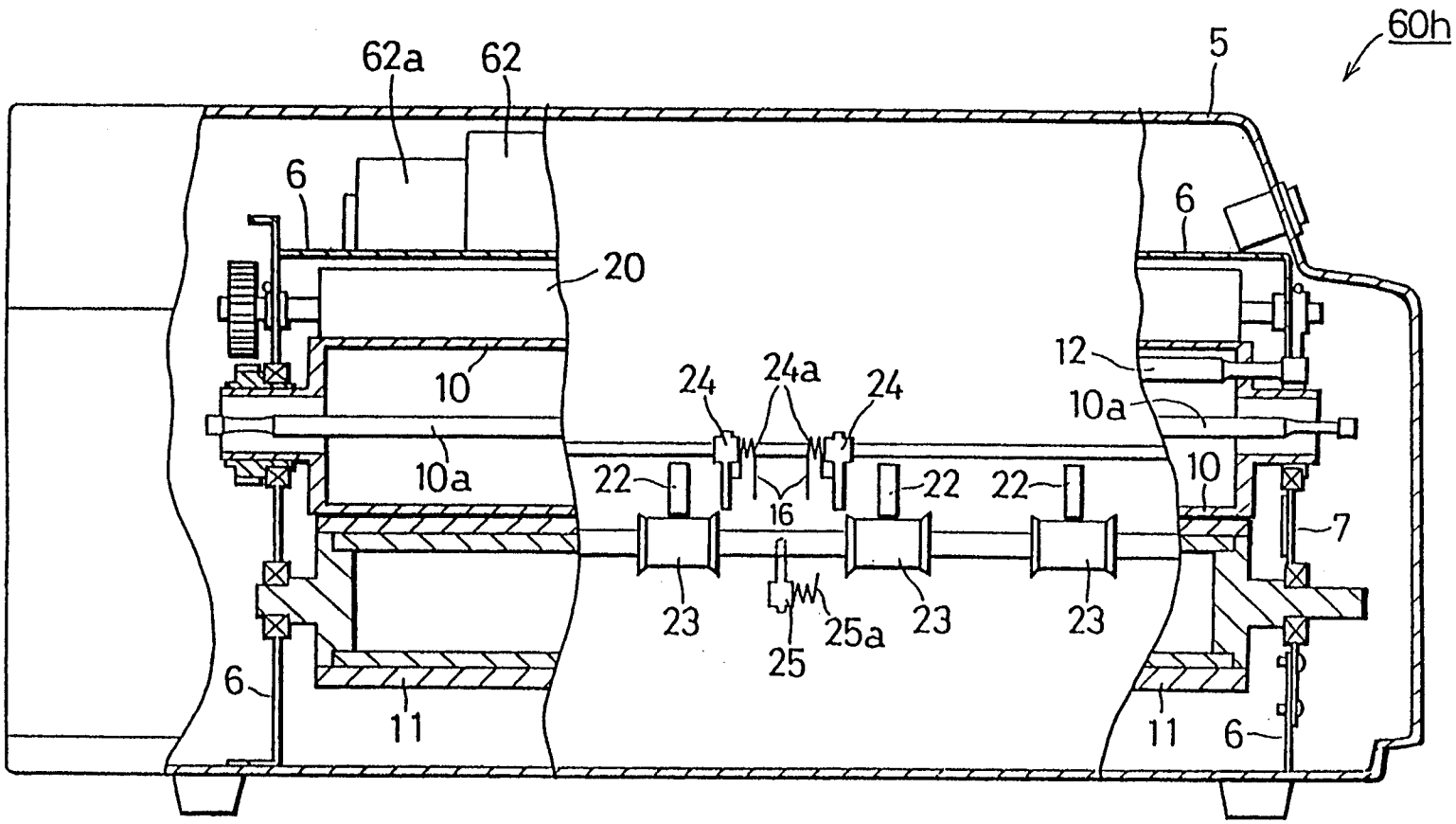
FIG. 13 is a fragmentary side elevation view showing the configuration of the decolorizing apparatus 60*h* of FIG. 12.

FIG. 13 is a fragmentary side elevation view showing the configuration of the decolorizing apparatus **60*h* of FIG. 12. The heating roller 10, press roller 11, and cleaning rollers 20 and 21 are rotatably supported by a frame 6 and an auxiliary side plate 7. The heater 10*a*, such as a tungsten halogen lamp, is incorporated in the shaft portion of the heating roller 10. When any of the rollers 10, 11, 20 and 21 is to be replaced, therefore, the roller to be replaced can be accessed only by removing the auxiliary side plate 7 and without disassembling the whole of the frame 6**, thereby improving the workability of the maintenance operation.

As shown in the center of the fragmentary portion of FIG. 13, a plurality of the discharge rollers 22 and 23 are rotatably supported along the width direction of the sheet 106 at predetermined intervals. Similarly, a plurality of the separating claws 24 and 25 are disposed along the width direction of the sheet 106 with predetermined intervals. The separating claws 24 and 25 are respectively provided with coil springs 24*a* and 25*a* so that their tips are forced to contact with the surface of the heating roller 10 and press roller 11 at a predetermined pressure. As shown in FIG. 12, one end of the coil spring 24*a* which biases the separating claw 24 is elongated perpendicular to the axis of the discharge rollers 22 and bent to form a smooth curve, so that the elongated portion can function also as the guide member 16. The exhaust fan 62 is driven by a motor 62*a*.

Figure 14:
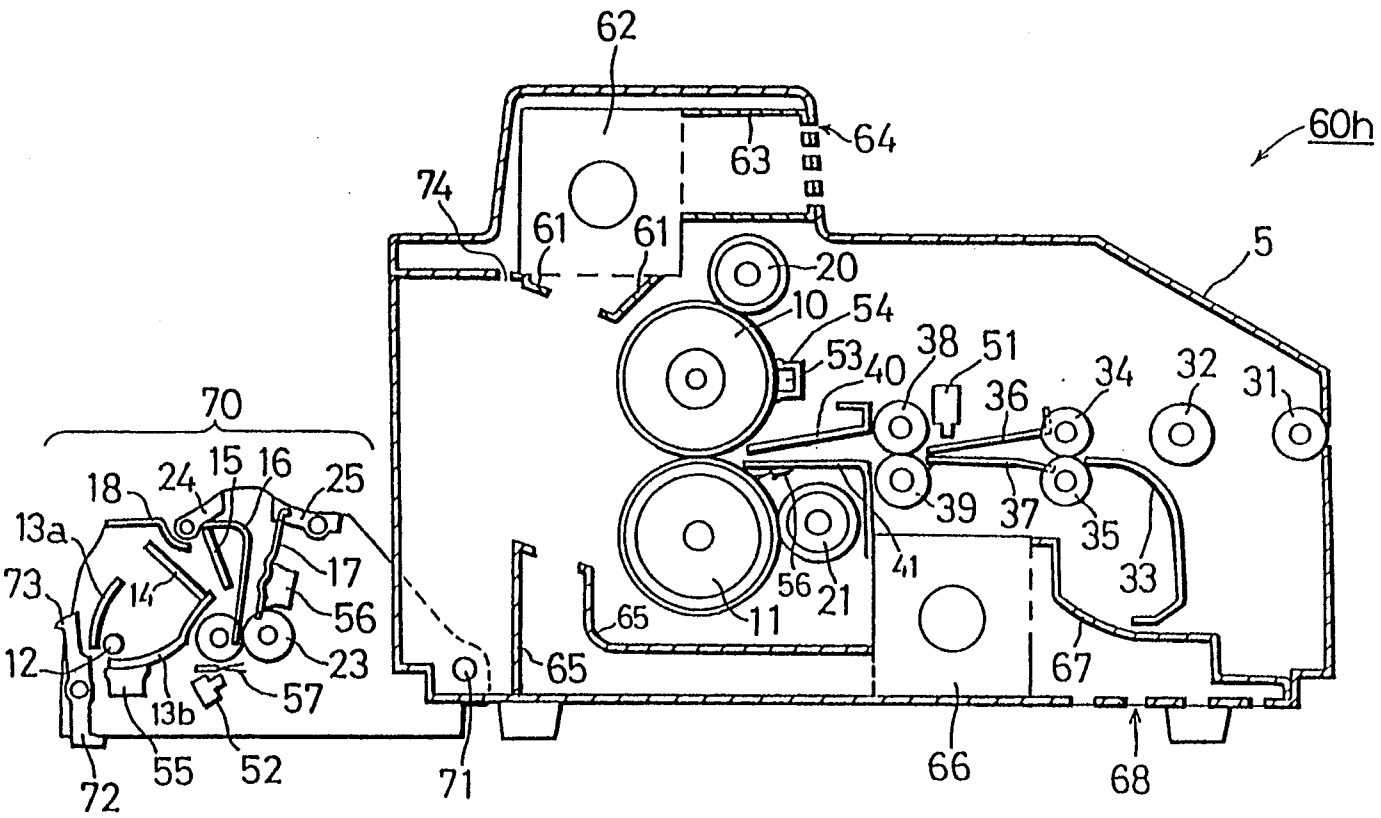
FIG. 14 is a sectional view showing the state in which a light source unit 70 of the decolorizing apparatus 60*h* of FIG. 12 is rotated on an axis 71 to open.

FIG. 14 is a front view showing the state in which a light source unit 70 of the decolorizing apparatus 60*h* of FIG. 12 is rotated around an axis 71 to open. When the sheet 106 is blocked subsequent to the heating roller pair 10 and 11, i.e., there is a so-called jam, this jam can be removed in the following manner. In the state of FIG. 12, the discharge tray 42 is removed, and thereafter an engaging member 72 disposed at the upper portion of the light source unit 70 is manually operated to unlock the engagement between a claw 73 of the engaging member 72 and a hole 74 formed on a housing 5. Then the light source unit 70 is rotated to swing outward so that a large space is formed on the discharge side of the heating roller pair 10 and 11 and that the inside of the light source unit 70 can be easily observed. This allows the user to remove a jam in safety and with ease.

After the removal of a jam, the light source unit 70 is pushed into the housing 5, whereby the engagement between the claw 73 of the engaging member 72 and the hole 74 of the housing 5 is easily made again. In this way, the opening and closing facility of the light source unit 70 facilitates the jam removing operation. The light source unit 70 may be constructed so as to horizontally move along linear guiding means such as a rail. A shaft detachably mounted to the housing may be used as the axis 71 so that the light source unit 70 can be detached from the body of the decolorizing apparatus.

Figure 15:
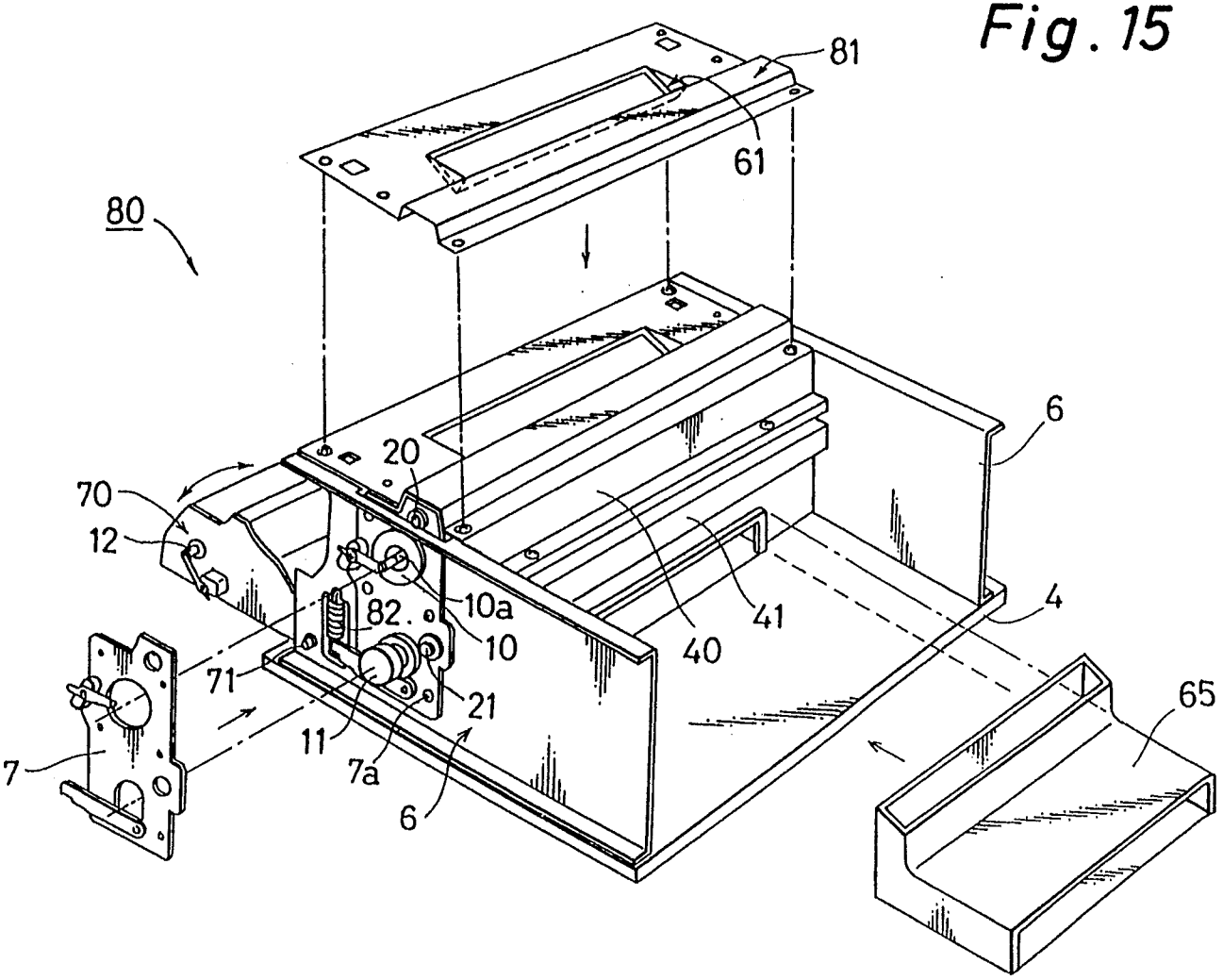
FIG. 15 is an exploded perspective view showing a decolorizing unit 80.

FIG. 15 is an exploded perspective view showing a decolorizing unit 80. The decolorizing unit 80 comprises the heating roller pair 10 and 11, the cleaning rollers 20 and 21, the guide members 40 and 41, the light source unit 70, and a bottom plate 4, frame 6 and auxiliary side plate 7 which support these components. The exhaust duct 65 is mounted at a portion between the heating roller pair 10 and 11 and the bottom plate 4, and a top cover 81 to which the exhaust duct 61 is unitedly attached is mounted above the heating roller pair 10 and 11. The press roller 11 is forced toward the heating roller 10 by a coil spring 82.

The auxiliary side plate 7 by which the heating roller pair 10 and 11 and the cleaning rollers 20 and 21 are rotatably supported through bearings is detachably mounted to the frame 6 by fixing members 7*a*, such as screws. As described above, therefore, it is possible to easily and quickly perform maintenance operations on the rollers 10, 11, 20 and 21.

Figure 16:
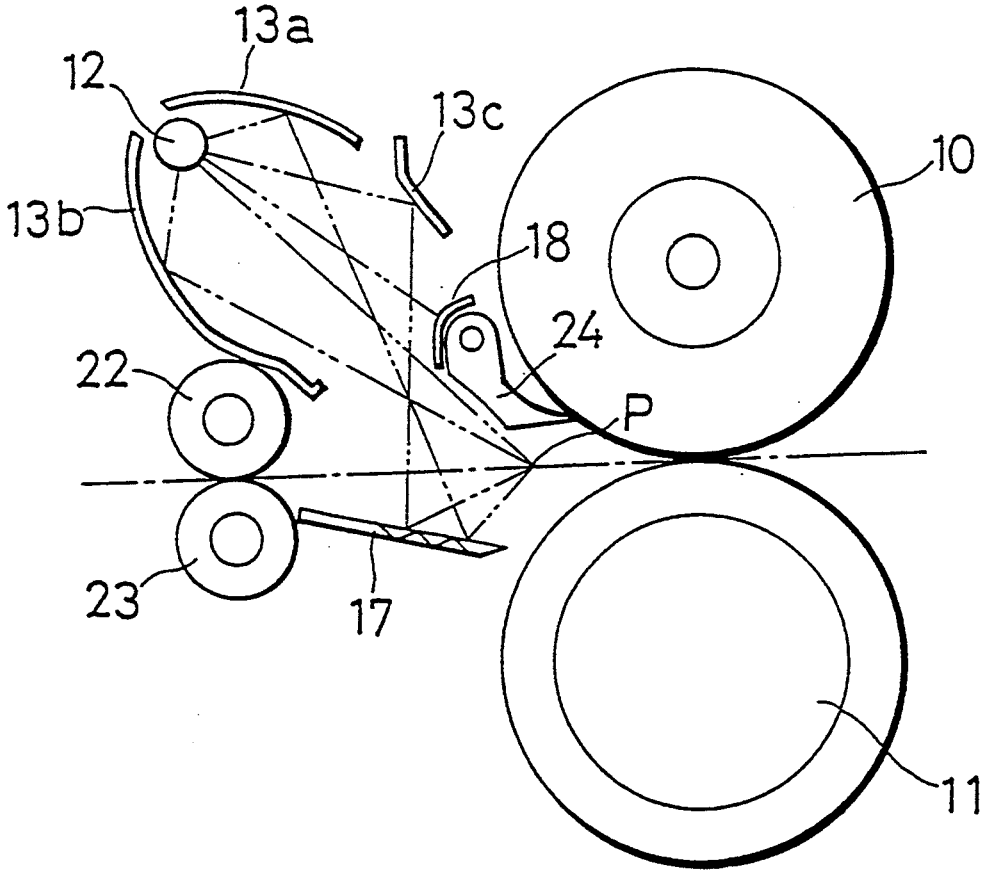
FIG. 16 is a partial view showing the configuration of an optical system of a light source 12 and a light condensing portion P.

FIG. 16 is a partial view showing the configuration of an optical system of the light source 12 and a light condensing portion P. Although one portion of the light emitted from the light source 12 directly reaches the light condensing P, most portion of the light is reflected by reflecting mirrors 13*a*, 13*b* and 13*c*. The light reflected by the reflecting mirror 13*b* is directed toward the light condensing portion P. The light reflected by the reflecting mirrors 13*a* and 13*c* proceeds to the guide member 17 having a mirror surface, and is again reflected by the guide member 17 to converge on the light condensing portion P. In addition to the formation of the mirror surface, the guide member 17 may be further optically processed in order to improve the light converging efficiency to a greater degree. Namely, the guide member 17 may be formed into a triangular wave shape so that the light source 12 and the light condensing portion P are positionally set in the direction of regular reflection. Therefore, the guide member 17 functions as a means for smoothly transporting the sheet 106 and also improving the light converging efficiency. Even when the sheet 106 moves over the guide member 17, the light from the light source 12 can transmit through the sheet 106 with an attenuation of a small degree, thereby allowing the light converging function of the guide member 17 to continue. In case the light source 12 has a large output power, the separating claw 24, made of resin, may be overheated and deformed. Hence, it is preferable that a metal protective cover 18 is disposed in front of the separating claw 24.

Figure 17:
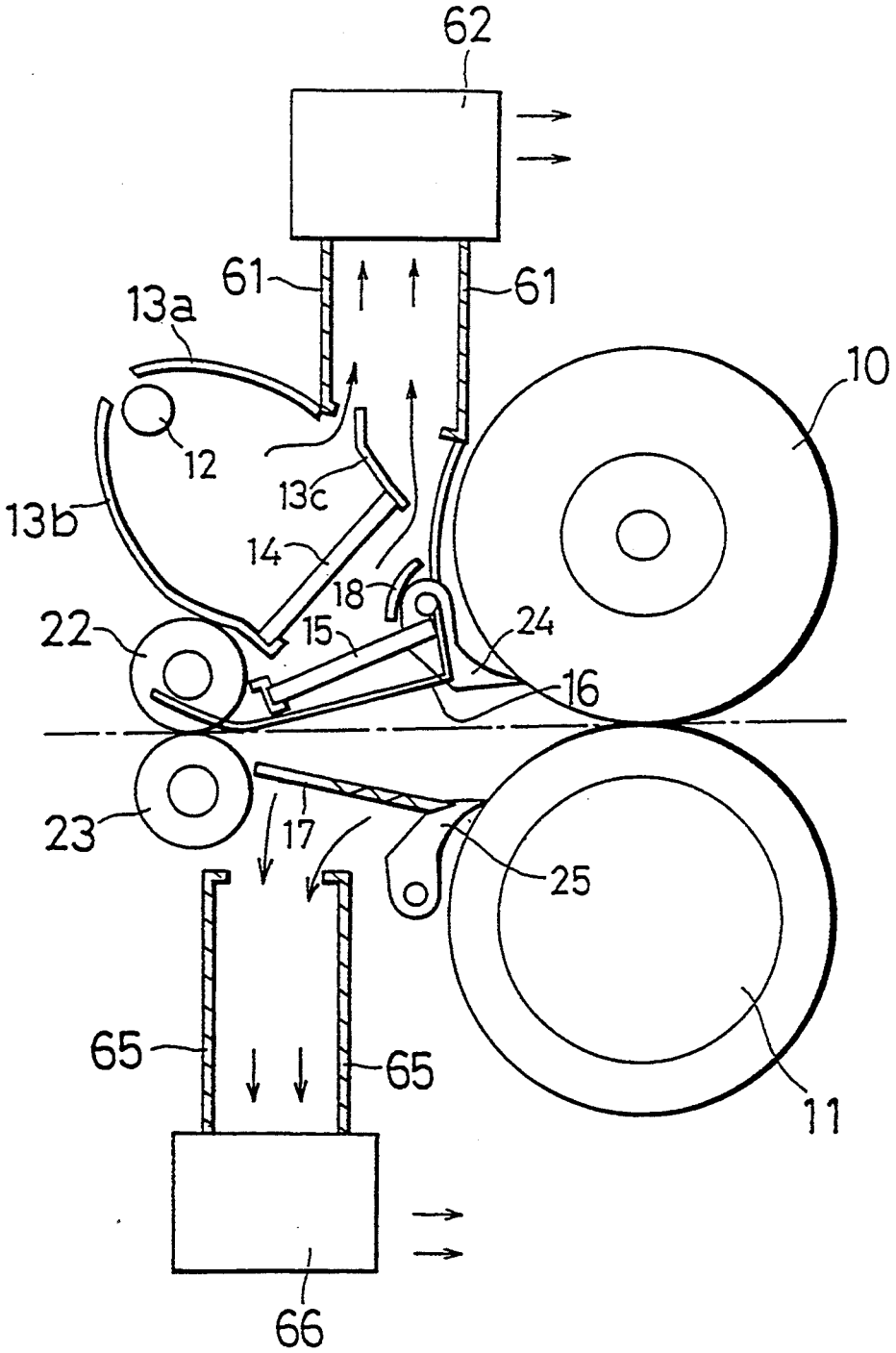
FIG. 17 is a partial view showing the state of the heat exhaustion in the vicinity of the light source 12 and a pair of heating rollers 10 and 11.

FIG. 17 is a partial view showing heat exhaustion in the vicinity of the light source 12 and the heating roller pair 10 and 11. In addition to improved light converging efficiency of the optics from the light source 12 to the light condensing portion P, a large output power of the light source 12 will contribute the efficient and rapid decolorization of the decolorizable toner. Therefore, it is required to exhaust hot air to the exterior of the apparatus while reducing the effect of the waste heat of the light source on the other members. The light source 12 emits light having a wavelength distribution ranging from visible light to far infrared rays and generates a large amount of heat. Members which directly receive light from the light source 12 absorb the light to elevate their temperature, resulting in that the air in the vicinity of the light source 12 and the heating roller pair 10 and 11 becomes hot. Accordingly, the exhaust duct 61 to which the exhaust fan 62 is connected is disposed in the upper portion of the apparatus, and the exhaust duct 65 to which the exhaust fan 66 is connected is disposed in the lower portion of the apparatus. The provision of the heat resisting glass plates 14 and 15 between the light source 12 and the light condensing portion P enables the air flow to be smoothly conducted without substantially interrupting the light from the light source 12, thereby preventing the air from continuing to stay in the interior. The exhaustion from the upper and lower sides of the transporting path of the sheet 106 improves the ventilation efficiency and prevents the sheet 106 from being subjected to deformations such as warp, and flapping, caused by the exhaust pressure difference between the sides of the sheet 106, thereby suppressing the occurrence rate of jams.

Figure 18:
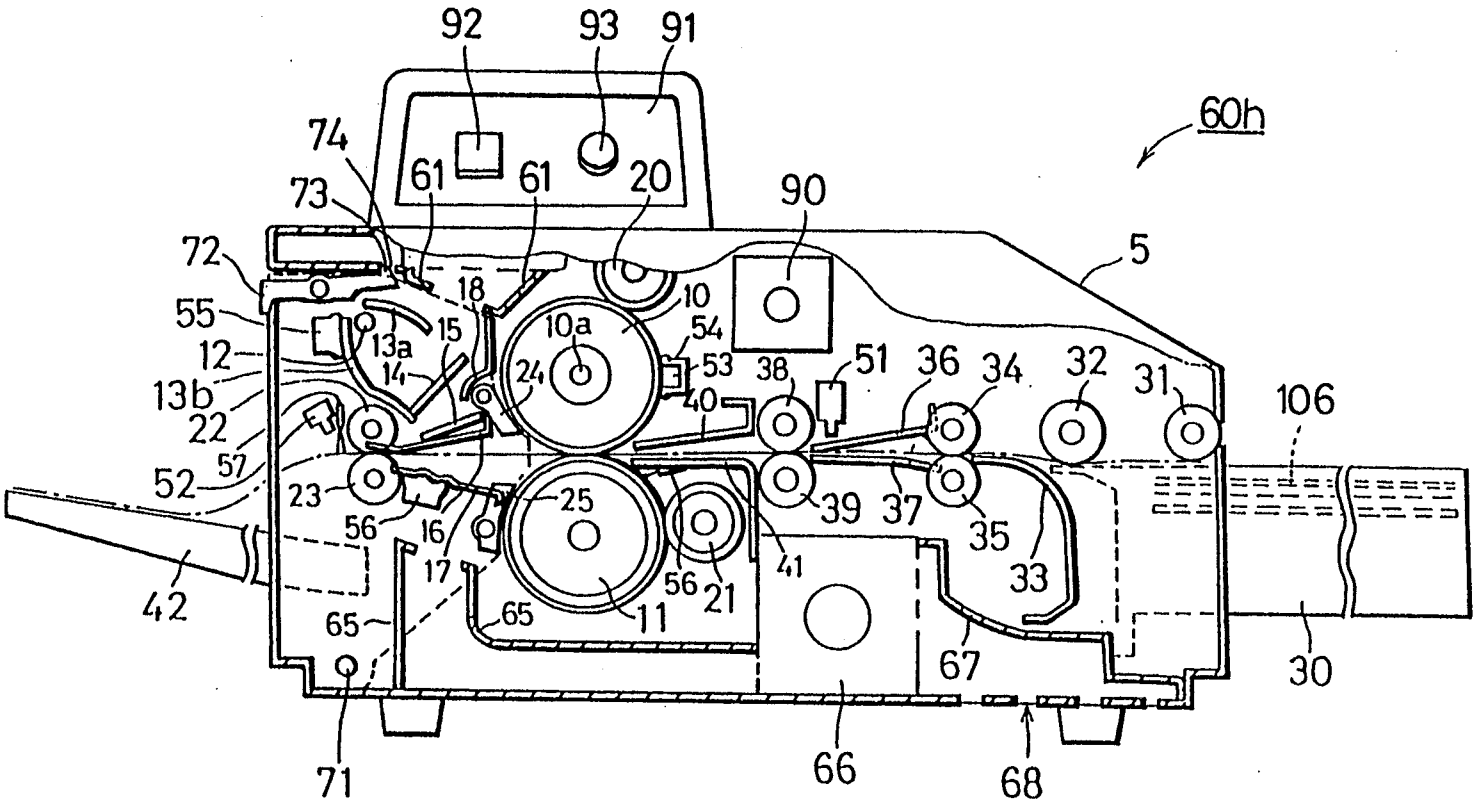
FIG. 18 is a fragmentary front view showing an operation panel 91 of the decolorizing apparatus 60*h* of FIG. 12.

FIG. 18 is a fragmentary front view showing an operation panel 91 of the decolorizing apparatus 60*h* of FIG. 12. When an operation switch 92 on the operation panel 91 is pressed, the sheets 106 in the sheet supply cassette 30 are taken out one by one, and the decolorization operation is continuously carried out. The apparatus may be modified so that one of the sheets 106 is processed for each operation of the switch.

By operating a speed control dial 93, the rotational speed of a driving motor 90, which drives the rollers 34, 38, 39, 10, 11, 22 and 23, is controlled so that the transporting speed of the sheet 106 is set to a desired value. When the sheet 106 carrying toner which is easily decolorized is to be processed or the color of the toner is allowed to remain visible to some degree, the sheet 106 may be transported at a higher speed so that the decolorization operation is rapidly conducted. In contrast, when the sheet 106 carrying toner which is difficult to be decolorized is to be processed, the transporting speed of the sheet 106 may be set to a lower speed so that the sheet is subject to the sufficient heating and light illumination, whereby the decolorization is surely conducted. In case the sheet 106 carrying toner cannot be decolorized by one decolorization process, the sheet 106 may be returned to the sheet supply cassette 30 so that the decolorization process is repeatedly conducted, whereby the decolorization is more surely conducted.

Ninth Embodiment

Figure 19A:
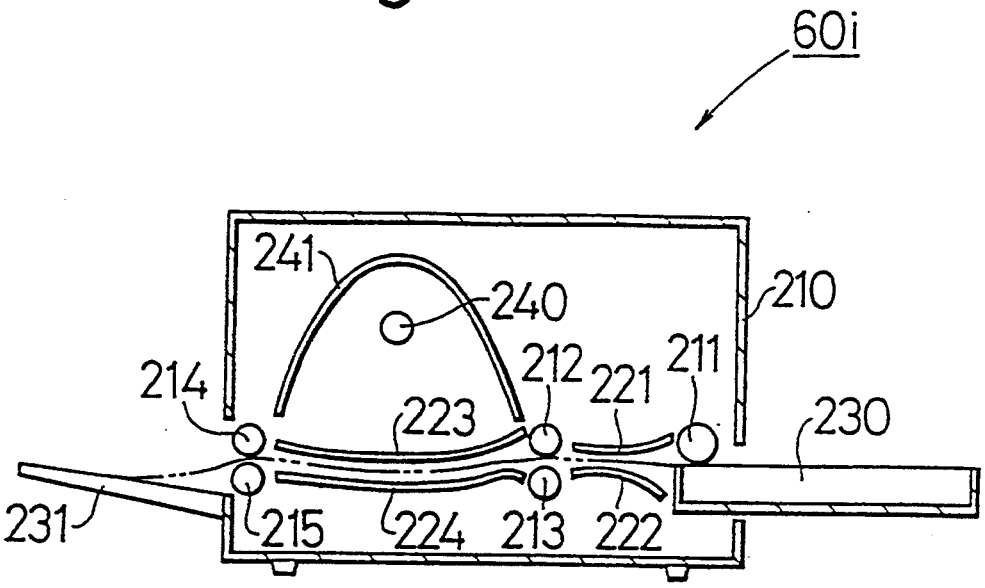
FIG. 19(*a*) is a sectional view showing the configuration of a decolorizing apparatus 60*i* for a decolorizing method, and FIG. 19(*b*) is a plan view of the apparatus.
Figure 19B:
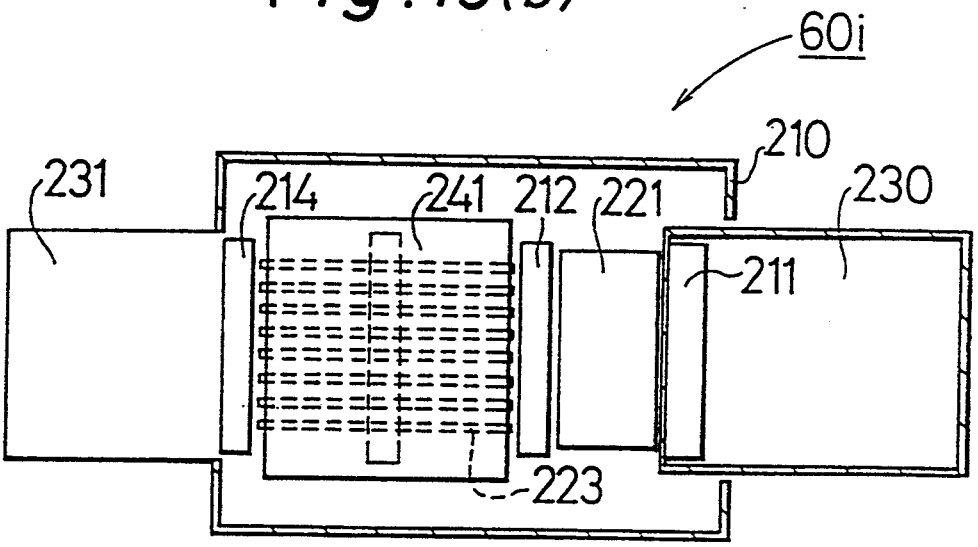

FIG. 19(*a*) is a sectional view showing the configuration of a decolorizing apparatus 60*i* for a decolorizing method, and FIG. 19(*b*) is a plan view of the apparatus. The decolorizing apparatus 60*i* comprises a sheet supply cassette 230 which accommodates sheets of paper or plastic on which photochemically decolorizable toner is fixed, a supply roller 211 for taking out the sheets in the supply cassette 230, transporting rollers 212,213,214 and 215 which transport the sheet along the one-dot chain line in FIG. 25(*a*), guide members 221,222,223 and 224 for guiding the sheet, a light source 240 for illuminating the toner fixed on the sheet with near infrared rays and heating the toner by radiation heat to a temperature equal to or higher than the glass-transition temperature of the binding resin of the toner, a concave mirror 241 for converging the light emitted from the light source 240 to the sheet positioned between the guide members 223 and 224, a discharge tray 231 which receives the sheet discharged from the transporting rollers 214 and 215, and a housing 210 which supports and accommodates these components.

Figure 20:
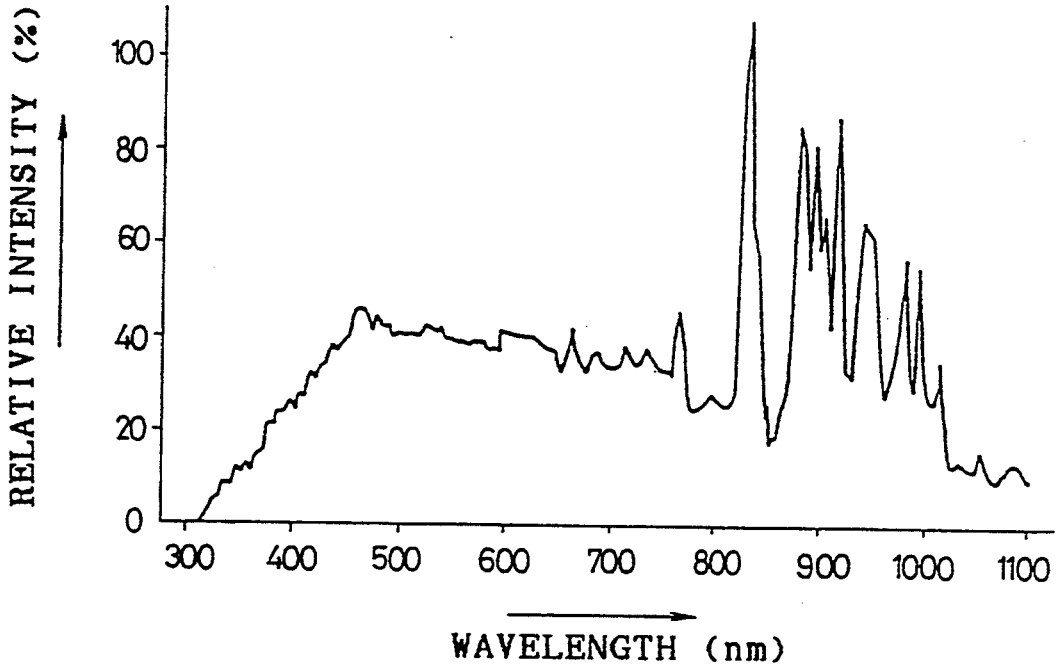
FIG. 20 is a graph showing a typical emission spectrum of a xenon flashlamp.

Preferably a lamp such as a xenon flashlamp, which emits a large amount of near infrared rays and radiation heat, is used as the light source 240. FIG. 20 is a graph showing a typical emission spectrum of a xenon flashlamp. As shown in FIG. 20, it will be understood that a xenon flashlamp emits a large power of near infrared rays having sharp peaks in the wavelength range of 800 nm to 1050 nm and therefore is adequate for the operation of decolorizing the toner. Generally, a xenon flashlamp is characterized in that it can emit light of a very high energy and at a selective wavelength in an emission period of shorter than about 3 msec. When the emitted energy is efficiently converged, therefore, it is possible to locally obtain a very high light energy. Moreover, a xenon flashlamp can emit a sufficient amount of light without preheating immediately after the energization.

Figure 21:
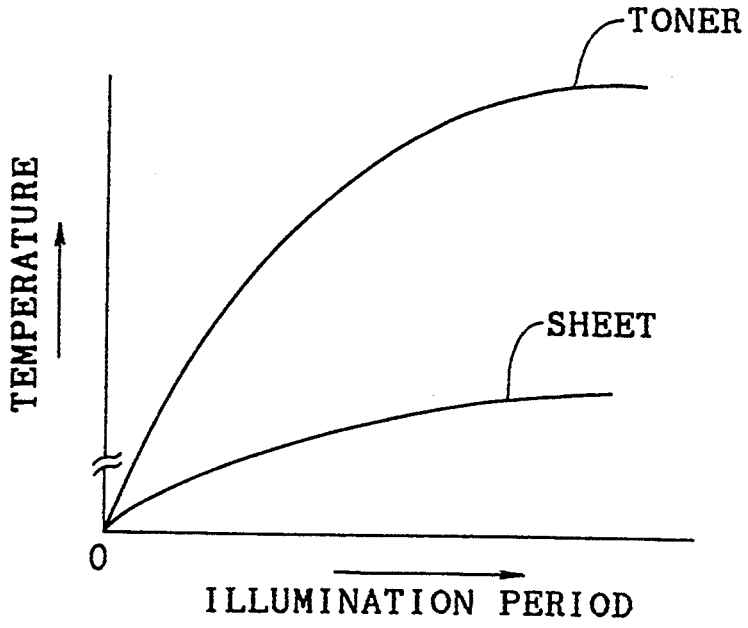
FIG. 21 is a graph showing a temperature elevation curve of a sheet and toner.

The operation of the apparatus will be described as follows. The sheets accommodated in the supply cassette 230 are taken out one by one by the supply roller 211, and guided by the guide members 221 and 222 along the one-dot chain line in the figure, and then sent by the transporting rollers 212 and 213 between the guide members 223 and 224. In order not to obstruct the illumination, the guide member 223, which is positioned on the side of the light source 240, consists of a plurality of linear members which are formed by bending wires to extend along the transporting direction of the sheet and are arranged at predetermined intervals perpendicular to the transporting direction of the sheet. The guide member 224 may be made of metal plate and preferably has a reflective surface directed toward the transport path. During the transportation of the sheet, the light source 240 repeatedly emits light, so that the toner of the sheet is illuminated with near infrared rays and heated with the radiation heat. In a comparison of a white or colorless and transparent sheet with the toner in which the above-mentioned pigment has been dispersed, there generally exists a difference in the efficiency of absorbing light energy per unit period of time, and therefore the rate of temperature rise of the toner is greater than that of the sheet, as shown in FIG. 21. Consequently, the employment of the heating method due to the radiation heat can improve the efficiency of heating the toner and prevent the sheet from being overheated. In order to obtain a uniform distribution of optical intensity on the entire surface of the sheet, it is preferable that a parabolic mirror is used as the concave mirror 241 and the light source 240 is placed at the focal point of the parabolic mirror. In case the sheet is illuminated while stopped at the position of the guide members 223 and 24 for a predetermined period, the sheet can be illuminated with a sufficient amount of light so that the decolorization operation is more surely conducted. The sheet which has been subjected to the decolorization operation is discharged onto the discharge tray 231 by the transporting rollers 214 and 215.

In this way, when the sheets on which images are once formed from the toner are transported from the supply cassette 230 to the discharge tray 231, the toner is efficiently and quickly decolorized.

Tenth Embodiment

Figure 22:
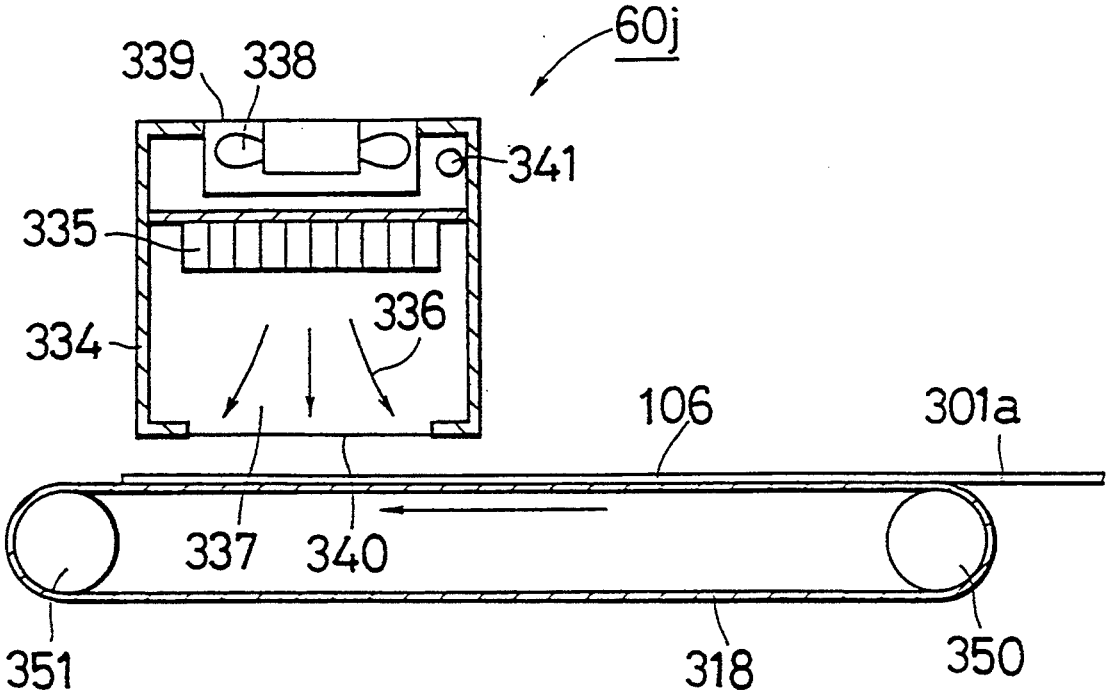
FIG. 22 is a sectional view showing the configuration of a decolorizing apparatus 60*j* as a part of an image forming apparatus.

FIG. 22 is a sectional view showing part of an image forming apparatus which has a decolorizing function and shows a decolorizing means 60*j* disposed in a transporting path 301*a* for a sheet 106. The decolorizing means 60*j* is mounted in a body 304 of a copier 300 shown in FIG. 23. Electrostatic photography image forming means 305 is disposed on the upstream side of the transporting path 301*a*. Sheets 106*a* are supplied one by one from a manual sheet supply port 310 by a sheet supply roller 307, and sheets 106*b* stacked on a supply cassette 308 are supplied one by one by a sheet supply roller 309. The sheets 106*a* and 106*b* may be generally designated by reference numeral 106.

In the electrostatic photography image forming means 305, a cylindrical photoconductive body 311 is rotated in the direction of arrow 312. The surface of the photoconductive body 311 is electrically charged by a corona charger 313, and in an exposure region 314 an original image is exposed to form a latent image. The latent image is visualized into a toner image by, for example, a magnetic brush of a developer 315, and the toner image of the photoconductive body 311 is transferred by the transfer corona discharger 316 to the sheet 106 transported through transporting path 30lb. Then, the sheet 106 is separated from the photoconductive body 311 by a separation corona discharger 317. The sheet 106 bearing the thus transferred toner image is transported by an endless belt 318, such as an aramid film belt or the like, which is disposed in the transporting path 301*a*. The toner remaining on the photoconductive body 311 after the transfer is removed by cleaning means 319.

In order to form an original image in the exposure region 314, an original 321 is placed on a transparent platen 320, which is horizontally disposed in the upper portion of the body 304, and then covered by a cover 322. The original 321 is illuminated through the transparent platen 320 by a light source 323, and the original image is directed to the exposure region 314 through an optical system 327 which includes a reflecting mirror 324, a lens 325 and a reflecting mirror 326. By relatively moving the original 321 with respect to one portion of the optical system 327 in the right and left direction as viewed in FIG. 23, the slit exposure is carried out. The sheet, after the transfer process, is transported onto the endless belt 318, and sandwiched to be subjected to a thermal fixing process, by a pressure roller 329 and a heating roller 330 of a fixing device 328, which is disposed downstream in the transporting direction of the sheet. The sheet which has been subjected to the thermal fixing process is discharged onto a discharge tray 332 by discharging rollers 331.

The decolorizing means **60*j* mounted in the body 304 has a configuration as shown in FIG. 22. A light source 335 emitting near infrared rays for decolorization is disposed in a housing 334, which is made of a light-shielding material such as a metal. The light source 335 may be a tungsten halogen lamp, a light emitting diode, a semiconductor laser device, or the like. The light emitted from the light source 335 as indicated by arrows 336 impinges onto the upper surface of the sheet 106 on the conveyor 318, through an opening 337 formed in the lower portion of the housing 34. An image formed from the toner has already been fixed to the upper surface of the sheet 106. When the toner on the sheet 106 is illuminated with near infrared rays emitted through the opening 337 from the light source 335, the toner image becomes colorless, resulting in that the decolorized sheet 106** can be made reusable.

A cooling fan 338 for cooling the light source 335 is disposed in the housing 334 so that air is sucked in through an opening 339 formed in the upper portion of the housing 334 to be directed to the light source 335. The cooling air is exhausted from the opening 337. In the opening 337, a plurality of wires 340 extend horizontally in the transporting direction of the sheet 106, or the right and left direction as viewed in FIG. 22, and are arranged with therebetween intervals in a direction perpendicular to the transporting direction. The wires are fixed to the lower portion of the housing 334. Even when the sheet 106 rises on the belt 318, this configuration prevents the sheet 106 from entering into the opening 337 or being caught on the wires 340, resulting in that the sheet 106 can be smoothly transported and prevented from Jamming. Safety members such as a temperature detection element 341 and a fuse may be disposed in the housing 334.

Figure 23:
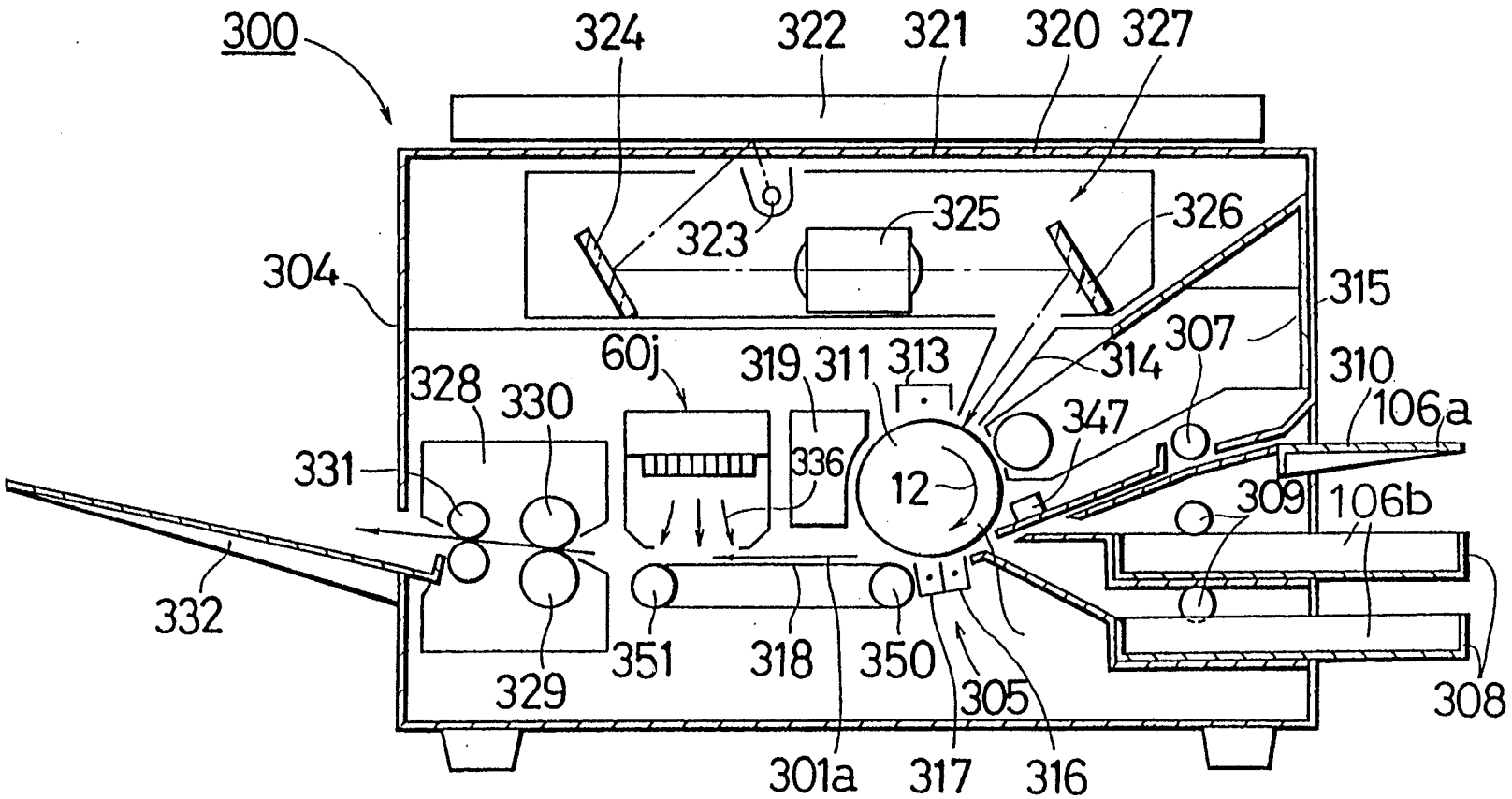
FIG. 23 is a sectional view of an entire image forming apparatus 300.
Figure 24:
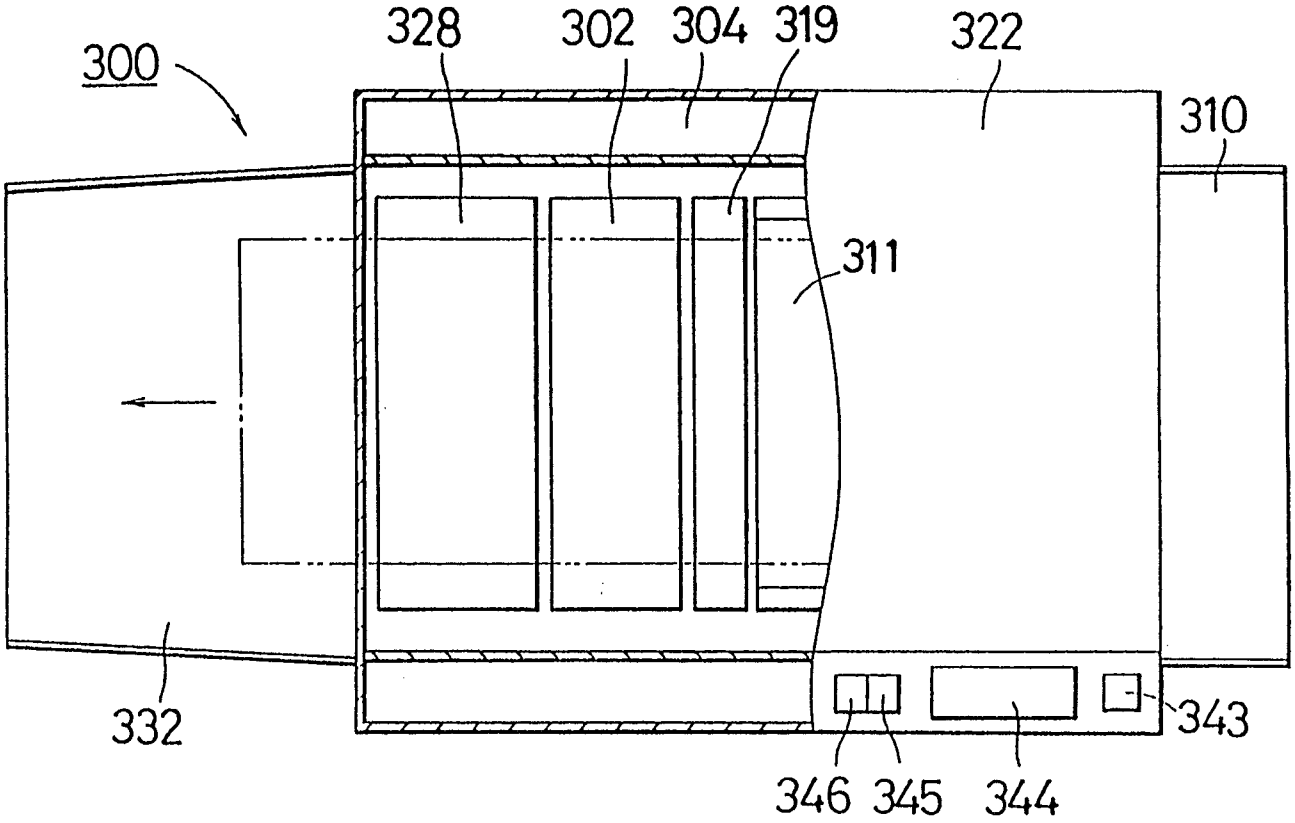
FIG. 24 is a partially cutaway plan view diagrammatically showing the image forming apparatus 300.

FIG. 24 is a partially cutaway plan view showing the image forming apparatus 300 in a simplified manner. A print button 343, which is operated to start the copy operation of the image forming means 305, and a display/input means 344 for a display and input operation are disposed on the front and upper portion of the body 304. A changeover switch 345 for switching between the copying and decolorization operations, and a switch 346 for starting the decolorization operation are further provided. As shown in FIG. 23, a sensor 347 for detecting whether or not a toner image is formed on the upper surface of the sheet 106 is disposed in the transporting path **301*b***.

Figure 25:
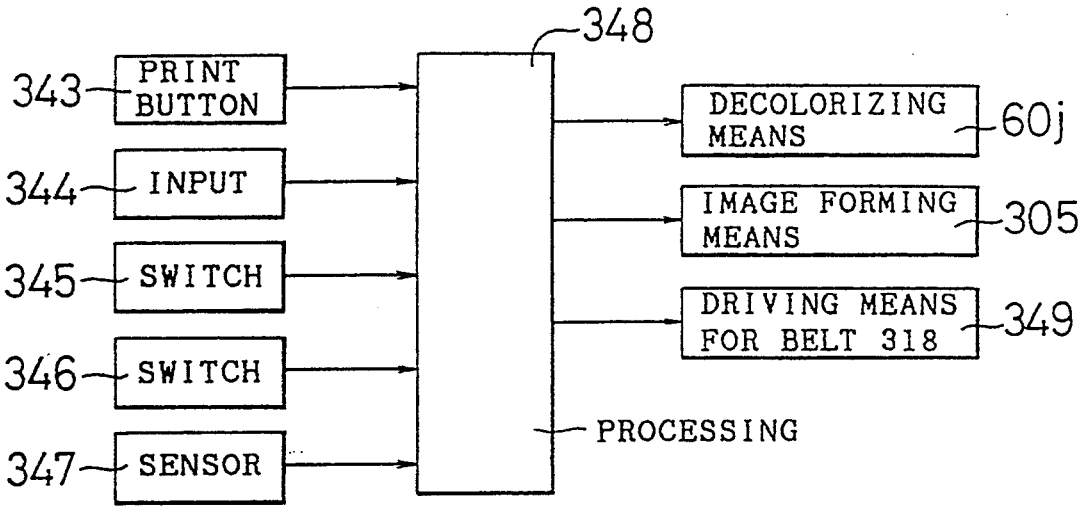
FIG. 25 is a block diagram showing the electrical configuration of the image forming apparatus 300 shown in FIGS. 22 to 24.

FIG. 25 is a block diagram showing the electrical configuration of the embodiment shown in FIGS. 22 to 24. The print button 343, display/input means 344, switches 345 and 346 and sensor 347 produce signals which are then supplied to a processing circuit 348 that constitutes a microcomputer or the like, thereby controlling the decolorizing apparatus **60*j*, the image forming means 305 and driving means 349 for the belt 318. The driving means 349 includes a pair of rollers 350 and 351, between which the belt 318 extends, and drives the roller 351** in a speed-variable manner.

Figure 26:
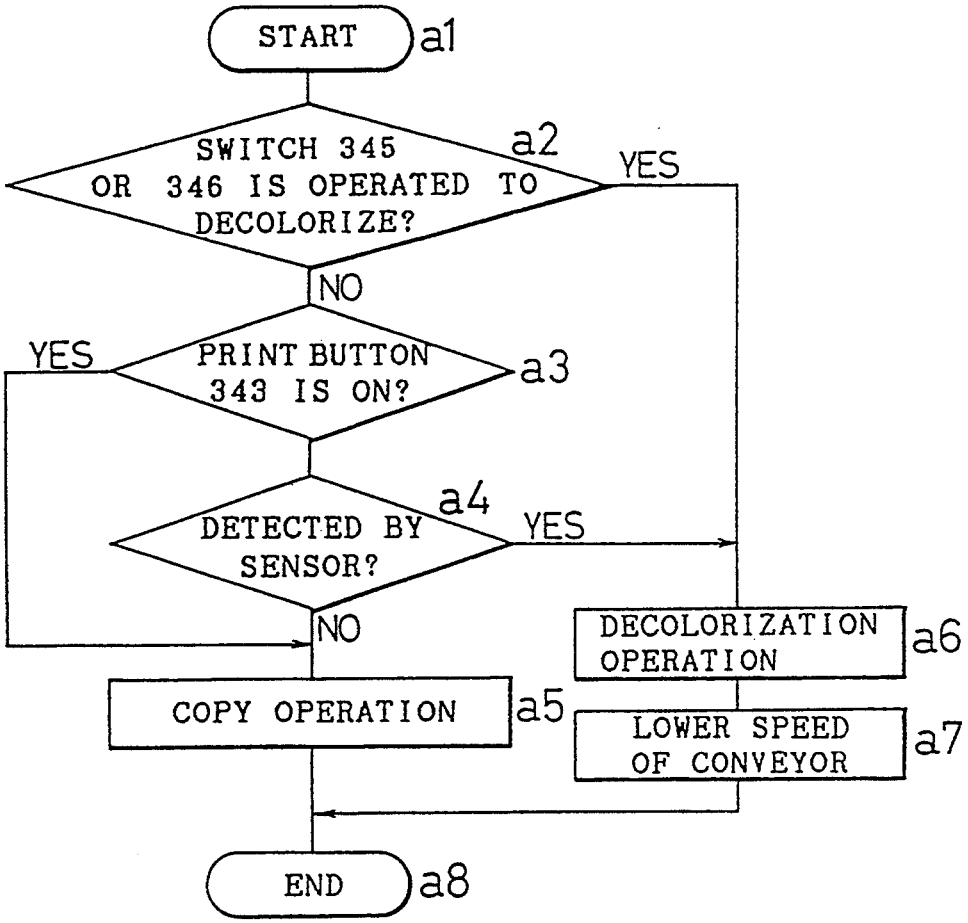
FIG. 26 is a flowchart illustrating the operation of a processing circuit 348 shown in FIG. 25.

FIG. 26 is a flowchart illustrating the operation of the processing circuit 348. The process proceeds from step a1 to step a2, and it is checked whether or not the copying/decolorization changeover switch 345 and the decolorization operation switch 346 are operated to carry out decolorization. When decolorization is not to be carried out, the process proceeds to the next step, i.e., step a3, to check whether or not the print button 343 is operated to start copying. When copying is not to be done, the process proceeds to step a4. In step a4, on the basis of the signal of the sensor 347, it is judged whether or not a toner image is formed on the upper surface of the sheet transported in the transporting path **301*b*. When no image is formed, i.e., the transported sheet 306 is white, the process proceeds to step a5. In step a5, the image forming means 305 performs electrostatic image formation operation to form the original image of the original 321 on the upper surface of the sheet 106, and after the fixation sheet 106 is discharged onto the discharge tray 332. When the print button 343** is operated in step a3, the process jumps to step a5.

When the copying/decolorization changeover switch 345 and the decolorization operation switch 346 are operated to start the decolorization operation, the process proceeds from step a2 to step a6. In step a6, the light source 335 of the decolorizing means **60*j* is energized to illuminate the toner image on the sheet 106 with near infrared rays and subjected to the decolorization operation. In step a7, in order that decolorization is surely achieved, the driving means 349 is controlled so that the transporting speed of the belt 318 during the decolorization operation is lower than that during the image forming operation. This enables the sheet 106 to be illuminated with a sufficient amount of light so that the decolorization operation is surely conducted, whereby the sheet 106** can be made reusable.

When the sheet 106 carrying a toner image thereon is transported in the transporting path **301*b*, the sensor 347 detects the existence of the image, and the decolorization operation is automatically conducted in steps a6 and When, after operating the print button 343 or the copying/decolorization changeover switch 345 to instruct the start of the copying operation, the operator finds that this instruction is wrong, the operator can immediately operate the copying/decolorization changeover switch 345 or the decolorization operation switch 846. This causes the process to jump to steps a6 and a7 to conduct the decolorization operation. In this way, when in the middle of the copying operation the operator finds that this copying is not necessary, the operator can control the image forming apparatus to immediately interrupt the unnecessary copying operation and start the decolorization operation, so that the sheet 106**, on which at least one portion of the copying operation has been conducted, can be subjected to the decolorization operation.

When the image forming means 80S conducts the copying operation in step a5, the decolorizing means remains stopped, and the discharging rollers 831 continue to operate. Similarly, when the decolorizing means **60*j* conducts the decolorizing operation in step a6, the image forming means 305 remains stopped, the fixing device 328 continues its thermal fixing operation, and the discharging rollers 331** continue to operate.

According to the thus configured embodiment, the sheet 106 on which an unnecessary copying operation has been done can be made reusable, thereby enabling resources to be effectively utilized. Since the electrostatic image forming means 305 and the decolorizing means 60*j* are housed in the sole body 303, the embodiment can be constructed in a reduced size and installed in a small space, as compared with the case wherein these components 60*j* and 305 are separately installed. This configuration, in which the image forming means 305 and the decolorizing means 60*j* are housed in the sole body 303, allows the manual sheet supply port 310, the sheet supply cassette 308, the discharge tray 332, etc. to be used commonly in both the copying and decolorization operations, whereby the decolorizing means 60*j* can be easily incorporated and the configuration can be simplified as compared with the case wherein the decolorizing means 60*j* and the image forming means 305 are separately installed. Furthermore, a decolorizing means 60*j* that can perform optimum decolorization on the toner used in the developing device 315 of the image forming means 305 is disposed in the common body 304. Therefore, the apparatus can conduct copying of a high quality using the toner, and surely attain decolorization of the toner, with the result that the sheet 106 carrying the toner that has been made colorless and transparent can be surely made reusable.

Eleventh Embodiment

Figure 27:
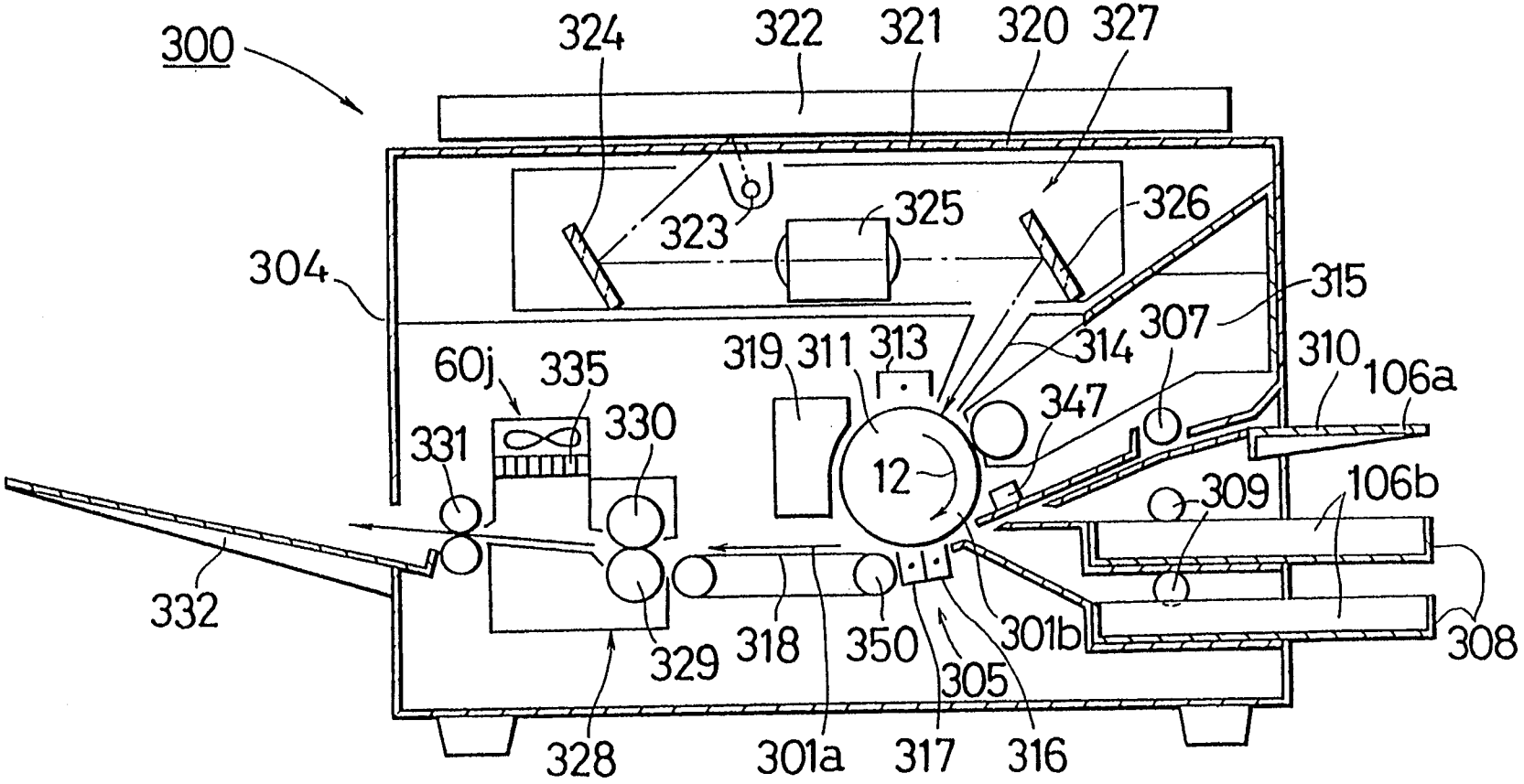
FIG. 27 is a sectional view showing another embodiment of the image forming apparatus.

FIG. 27 shows an embodiment in which a near infrared ray illumination device is disposed on the downstream side of a fixing device. More specifically, a decolorizing means 60*j* comprising a light source 335 is disposed in the downstream side of a fixing device 328. In this case, since the sheet has already been heated by a heating roller 330, the decolorizing effect due to the illumination by near infrared rays is improved in accordance with this heating.

The invention can be applied not only to the embodiments described above, but also to a wide range of printers and other electrostatic photography image forming means.

The method and apparatus of the invention are not restricted to the application to a toner which is contained in a developer for an electrostatic copier as described in the embodiments, but is also applicable to decolorizable ink for printing, stamping or writing which contains the pigment of Formula (1) or (2), or a wide variety of other pigments.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A decolorizing method comprising the steps of:

separately providing a heater and a near infrared ray source;

heating a toner image formed on a sheet from a photochemically decolorizable toner having a binding resin to at least the glass-transition temperature of the binding resin of the toner with the heater; and illuminating the toner image with near infrared rays from the near infrared ray source concurrently with said step of heating.

2. The decolorizing method of claim 1, wherein said step of heating further comprises heating the toner image to at least the softening point of the binding resin.

3. The decolorizing method of claim 1, wherein said step of heating further comprises heating the toner image to a temperature lower than the decomposition temperature of the components of the photochemically decolorizable toner.

4. The decolorizing method of claim 1, wherein said step of heating changes the binding resin from a solid state to an elastic state.

5. The decolorizing method of claim 1, wherein said step of heating changes the binding resin from a solid state to a melting state.

6. The decolorizing method of claim 1, wherein said step of illuminating comprises illuminating the toner image with direct light from a light source and with indirect light from the light source, the indirect light converging on the area illuminated by the direct light from the light source.

7. The decolorizing method of claim 1, wherein said step of illuminating comprises illuminating both sides of the sheet with near infrared rays.

8. The decolorizing method of claim 1, wherein said step of heating the toner image comprises employing a heat transfer medium other than near infrared rays.

9. A decolorizing method comprising the steps of:

heating a toner image formed on a sheet from a photochemically decolorizable toner having a binding resin to at least the glass-transition temperature of the binding resin of the toner; and illuminating the toner image with near infrared rays subsequently to said step of heating.

10. The decolorizing method of claim 9, wherein said step of heating further comprises heating the toner image to at least the softening point of the binding resin.

11. The decolorizing method of claim 9, wherein said step of heating further comprises heating the toner image to a temperature lower than the decomposition temperature of the components of the photochemically decolorizable toner.

12. The decolorizing method of claim 9, wherein said step of heating changes the binding resin from a solid state to an elastic state.

13. The decolorizing method of claim 9, wherein said step of heating changes the binding resin from a solid state to a melting state.

14. The decolorizing method of claim 9, wherein said step of illuminating comprises illuminating the toner image with direct light from a light source and with indirect light from the light source, the indirect light converging on the area illuminated by the direct light from the light source.

15. The decolorizing method of claim 9, wherein said step of illuminating comprises illuminating both sides of the sheet with near infrared rays.

16. The decolorizing method of claim 9, wherein said step of heating the toner image comprises employing a heat transfer medium other than near infrared rays.

17. A decolorizing method comprising the steps of:

heating a toner image formed on a sheet from a photochemically decolorizable toner having a binding resin to at least the glass-transition temperature of the binding resin of the toner;

illuminating the toner image with near infrared rays; and physically deforming the toner image no later than said step of illuminating the toner image with near infrared rays.

18. The decolorizing method of claim 17, wherein said step of physically deforming comprises rubbing and pressing the toner image.

19. The method of claim 17, and further comprising employing the same light source to perform said step of heating the toner image with radiation and said step of illuminating the toner image with near infrared rays.

20. The decolorizing method of claim 17, wherein said step of illuminating comprises illuminating the toner image with direct light from a light source and with indirect light from the light source, the indirect light converging on the area illuminated by the direct light from the light source.

21. The decolorizing method of claim 17, wherein said step of illuminating comprises illuminating both sides of the sheet with near infrared rays.

22. The decolorizing method of claim 17, wherein said step of heating the toner image comprises employing a heat transfer medium other than near infrared rays.

23. A decolorizing method comprising the steps of:

heating a toner image formed on a sheet from a photochemically decolorizable toner having a binding resin to at least the glass-transition temperature of the binding resin of the toner;

illuminating the toner image with near infrared rays; and at least partially removing a layer of the toner image so as to reduce the thickness thereof.

24. The method of claim 23, and further comprising employing the same light source to perform said step of heating the toner image with radiation and said step of illuminating the toner image with near infrared rays.

25. The decolorizing method of claim 23, wherein said step of illuminating comprises illuminating the toner image with direct light from a light source and with indirect light from the light source, the indirect light converging on the area illuminated by the direct light from the light source.

26. The decolorizing method of claim 23, wherein said step of illuminating comprises illuminating both sides of the sheet with near infrared rays.

27. The decolorizing method of claim 23, wherein said step of heating the toner image comprises employing a heat transfer medium other than near infrared rays.

* * * * *